US010651555B2

(12) United States Patent
Paulotto et al.

(10) Patent No.: US 10,651,555 B2
(45) Date of Patent: May 12, 2020

(54) MULTI-BAND MILLIMETER WAVE PATCH ANTENNAS

(71) Applicant: Apple Inc., Cupertino, CA (US)

(72) Inventors: Simone Paulotto, Redwood City, CA (US); Basim H. Noori, San Jose, CA (US); Matthew A. Mow, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 180 days.

(21) Appl. No.: 15/650,627

(22) Filed: Jul. 14, 2017

(65) Prior Publication Data

US 2019/0020110 A1 Jan. 17, 2019

(51) Int. Cl.
*H01Q 9/04* (2006.01)
*H01Q 5/20* (2015.01)
(Continued)

(52) U.S. Cl.
CPC ..... *H01Q 5/20* (2015.01); *H01Q 5/35* (2015.01); *H01Q 5/392* (2015.01); *H01Q 5/42* (2015.01);
(Continued)

(58) Field of Classification Search
CPC ..... H01Q 5/35; H01Q 5/42; H01Q 19/005; H01Q 21/065; H01Q 5/20; H01Q 9/045; H01Q 9/0414; H01Q 5/392
See application file for complete search history.

(56) References Cited

U.S. PATENT DOCUMENTS 6,191,740 B1 2/2001 Kates et al.
6,473,040 B1 * 10/2002 Nakamura ..... H01Q 9/0421 343/700 MS
(Continued)

FOREIGN PATENT DOCUMENTS

CN 104882672 A * 9/2015
JP 2017085289 A 5/2017
KR 101014347 B1 * 2/2011

OTHER PUBLICATIONS

Abdelaziz, Bandwidth Enhancement of Microstrip Antenna, Progress in Electromagnetics Research, 2006, pp. 311-317, vol. 63.
(Continued)

*Primary Examiner* — Dieu Hien T Duong
(74) *Attorney, Agent, or Firm* — Treyz Law Group, P.C.; Michael H. Lyons; Tianyi He

(57) ABSTRACT

An electronic device may be provided with wireless circuitry including first and second patch antennas. The first patch antenna may include a first resonating element formed over a ground plane. The second patch antenna may include a second resonating element over the first resonating element. A cross-shaped parasitic element may be formed over the second resonating element. First and second feed terminals may be coupled to the second resonating element. An opening may be formed in the first resonating element. First and second transmission lines may be coupled to the first and second feed terminals through the opening. The cross-shaped parasitic element may include arms that overlap the first and second feed terminals. The first resonating element may cover first frequencies between 10 GHz and 300 GHz and the second resonating element may cover second frequencies that are higher than the first frequencies.

20 Claims, 12 Drawing Sheets

(51) Int. Cl.

| | |
|---|---|
| ***H01Q 5/35*** | (2015.01) |
| ***H01Q 5/392*** | (2015.01) |
| ***H01Q 5/42*** | (2015.01) |
| ***H01Q 21/06*** | (2006.01) |
| ***H01Q 19/00*** | (2006.01) |

(52) U.S. Cl.
CPC ..... *H01Q 9/045* (2013.01); *H01Q 9/0414* (2013.01); *H01Q 19/005* (2013.01); *H01Q 21/065* (2013.01)

(56) References Cited

U.S. PATENT DOCUMENTS

| | | | | |
|---|---|---|---|---|
| 6,734,825 | B1 | 5/2004 | Guo et al. | |
| 7,595,759 | B2 | 9/2009 | Schlub et al. | |
| 8,102,330 | B1 * | 1/2012 | Albers | H01Q 5/40 333/117 |
| 9,142,886 | B2 | 9/2015 | Lu et al. | |
| 9,263,790 | B2 | 2/2016 | Sanford et al. | |
| 2005/0110685 | A1 * | 5/2005 | Frederik du Toit | H01Q 9/0414 343/700 MS |
| 2006/0267844 | A1 * | 11/2006 | Yanagi | H01P 1/203 343/700 MS |
| 2008/0316121 | A1 | 12/2008 | Hobson et al. | |
| 2014/0203995 | A1 | 7/2014 | Romney et al. | |
| 2014/0210486 | A1 | 7/2014 | Dijkstra | |
| 2015/0194730 | A1 * | 7/2015 | Sudo | H01Q 9/045 343/905 |
| 2015/0333407 | A1 * | 11/2015 | Yamagajo | H01Q 9/0414 343/905 |
| 2016/0141749 | A1 * | 5/2016 | Tagi | H01Q 1/38 343/872 |
| 2016/0261023 | A1 | 9/2016 | Di Nallo et al. | |
| 2017/0062938 | A1 | 3/2017 | Cheng et al. | |
| 2017/0110787 | A1 | 4/2017 | Ouyang et al. | |
| 2017/0117754 | A1 | 4/2017 | Noori et al. | |
| 2017/0256867 | A1 | 9/2017 | Ding et al. | |
| 2018/0159203 | A1 | 6/2018 | Baks et al. | |
| 2018/0198204 | A1 * | 7/2018 | Kovacic | H01Q 3/36 |

OTHER PUBLICATIONS

Khan, MultiBand—Rectangular Dielectric Resonator Antenna (M-RDRA), ResearchGate, 2016, pp. 1-115.
Mow et al., U.S. Appl. No. 15/217,805, filed Jul. 22, 2016.
Noori et al., U.S. Appl. No. 15/138,689, filed Apr. 26, 2016.
Noori et al., U.S. Appl. No. 15/138,684, filed Apr. 26, 2016.

* cited by examiner

MULTI-BAND MILLIMETER WAVE PATCH ANTENNAS

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. Operation at these frequencies may support high bandwidths but may raise significant challenges. For example, millimeter wave communications are often line-of-sight communications and can be characterized by substantial attenuation during signal propagation.

It would therefore be desirable to be able to provide electronic devices with improved wireless communications circuitry such as communications circuitry that supports communications at frequencies greater than 10 GHz.

SUMMARY

An electronic device may be provided with wireless circuitry. The wireless circuitry may include one or more antenna structures and transceiver circuitry such as millimeter wave transceiver circuitry. Antenna structures in the wireless circuitry may include co-located patch antennas that are organized in a phased antenna array.

The antenna structures may include a first patch antenna and a second patch antenna formed on a dielectric substrate. The dielectric substrate may include multiple dielectric layers. A ground plane may be formed on a first dielectric layer. The first patch antenna may include a first patch antenna resonating element formed from metal traces on a second dielectric layer. The second patch antenna may include a second patch antenna resonating element over the first patch antenna resonating element. The second patch antenna resonating element may be formed from metal traces on a third dielectric layer. A cross-shaped parasitic antenna resonating element may be formed over the second patch antenna resonating element and on a fourth dielectric layer.

The first patch antenna may be fed using a first transmission line coupled to a first feed terminal and a second transmission line coupled to a second feed terminal on the first patch antenna resonating element. Third and fourth feed terminals may be coupled to the second patch antenna resonating element. An opening such as a cross-shaped opening may be formed in the first patch antenna resonating element and may be configured to enhance isolation between the first and second feed terminals on the first patch antenna resonating element. The second patch antenna may be fed using third and fourth transmission lines coupled to the third and fourth feed terminals through the opening in the first patch antenna resonating element.

The cross-shaped parasitic antenna resonating element may have a first conductive arm that extends along a first longitudinal axis and a second conductive arm that extends along the second longitudinal axis that is oriented at a non-parallel angle with respect to the first longitudinal axis. The first conductive arm may overlap the third feed terminal and the second conductive arm may overlap the fourth feed terminal on the second patch antenna resonating element. The arms of the cross-shaped parasitic antenna resonating element and the cross-shaped opening in the first patch antenna resonating element may be oriented at parallel angles with respect to the edges of the second patch antenna resonating element.

The first patch antenna may convey antenna signals (e.g., centimeter wave signals) in a first frequency band such as a frequency band between 27.5 GHz and 28.5 GHz. The second patch antenna may convey antenna signals (e.g., millimeter wave signals) in a second frequency band such as a frequency band between 57 GHz and 71 GHz. Forming the second patch antenna resonating element over the first patch antenna resonating element may minimize the amount of space required for covering the first and second frequency bands within the electronic device.

DETAILED DESCRIPTION

Figure 1:
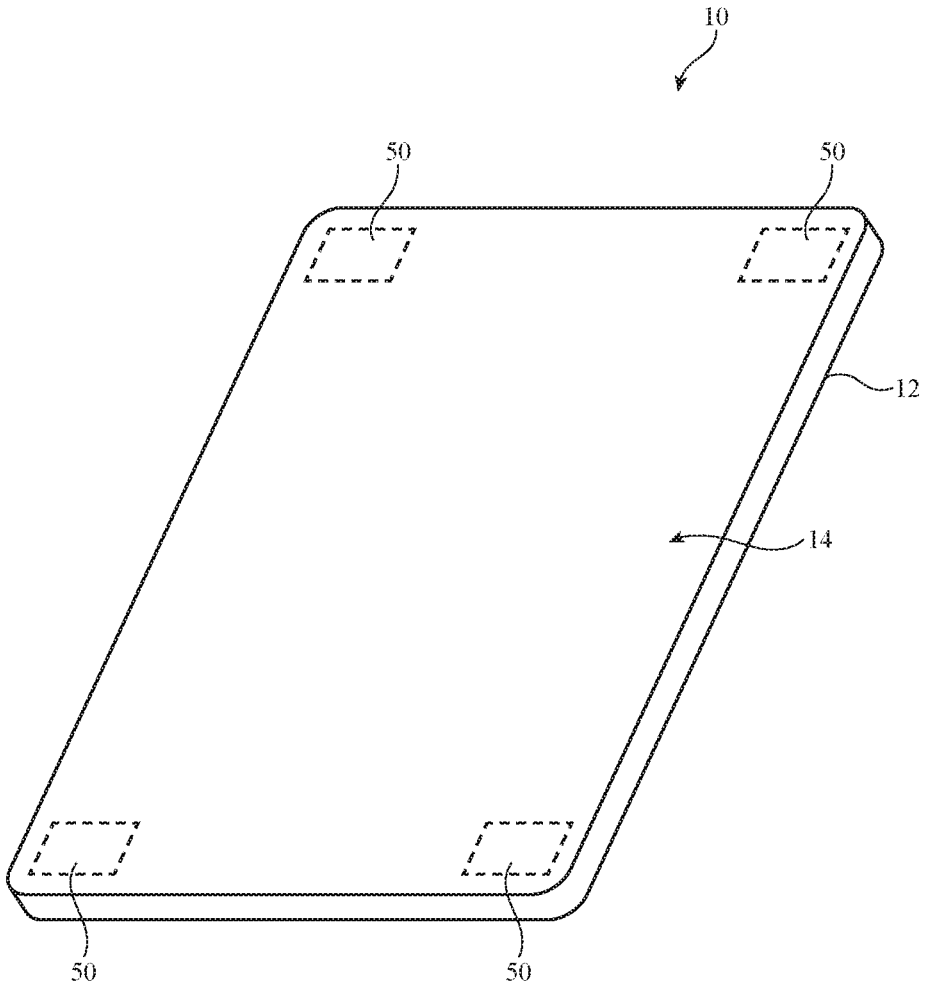
FIG. 1 is a perspective view of an illustrative electronic device with wireless communications circuitry in accordance with an embodiment.

An electronic device such as electronic device 10 of FIG. 1 may contain wireless circuitry. The wireless circuitry may include one or more antennas. The antennas may include phased antenna arrays that are used for handling millimeter wave and centimeter wave communications. Millimeter wave communications, which are sometimes referred to as extremely high frequency (EHF) communications, involve signals at 60 GHz or other frequencies between about 30

GHz and 300 GHz. Centimeter wave communications involve signals at frequencies between about 10 GHz and 30 GHz. If desired, device 10 may also contain wireless communications circuitry for handling satellite navigation system signals, cellular telephone signals, local wireless area network signals, near-field communications, light-based wireless communications, or other wireless communications.

Electronic device 10 may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a virtual or augmented reality headset device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, a wireless access point or base station, a desktop computer, a keyboard, a gaming controller, a computer mouse, a mousepad, a trackpad or touchpad, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

As shown in FIG. 1, device 10 may include a display such as display 14. Display 14 may be mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 14 may be protected using a display cover layer such as a layer of transparent glass, clear plastic, sapphire, or other transparent dielectric. Openings may be formed in the display cover layer. For example, openings may be formed in the display cover layer to accommodate one or more buttons, sensor circuitry such as a fingerprint sensor or light sensor, ports such as a speaker port or microphone port, etc. Openings may be formed in housing 12 to form communications ports (e.g., an audio jack port, a digital data port, charging port, etc.). Openings in housing 12 may also be formed for audio components such as a speaker and/or a microphone.

Antennas may be mounted in housing 12. If desired, some of the antennas (e.g., antenna arrays that may implement beam steering, etc.) may be mounted under an inactive border region of display 14 (see, e.g., illustrative antenna locations 50 of FIG. 1). Display 14 may contain an active area with an array of pixels (e.g., a central rectangular portion). Inactive areas of display 14 are free of pixels and may form borders for the active area. If desired, antennas may also operate through dielectric-filled openings in the rear of housing 12 or elsewhere in device 10.

To avoid disrupting communications when an external object such as a human hand or other body part of a user blocks one or more antennas, antennas may be mounted at multiple locations in housing 12. Sensor data such as proximity sensor data, real-time antenna impedance measurements, signal quality measurements such as received signal strength information, and other data may be used in determining when one or more antennas is being adversely affected due to the orientation of housing 12, blockage by a user's hand or other external object, or other environmental factors. Device 10 can then switch one or more replacement antennas into use in place of the antennas that are being adversely affected.

Antennas may be mounted at the corners of housing 12 (e.g., in corner locations 50 of FIG. 1 and/or in corner locations on the rear of housing 12), along the peripheral edges of housing 12, on the rear of housing 12, under the display cover glass or other dielectric display cover layer that is used in covering and protecting display 14 on the front of device 10, under a dielectric window on a rear face of housing 12 or the edge of housing 12, or elsewhere in device 10.

Figure 2:
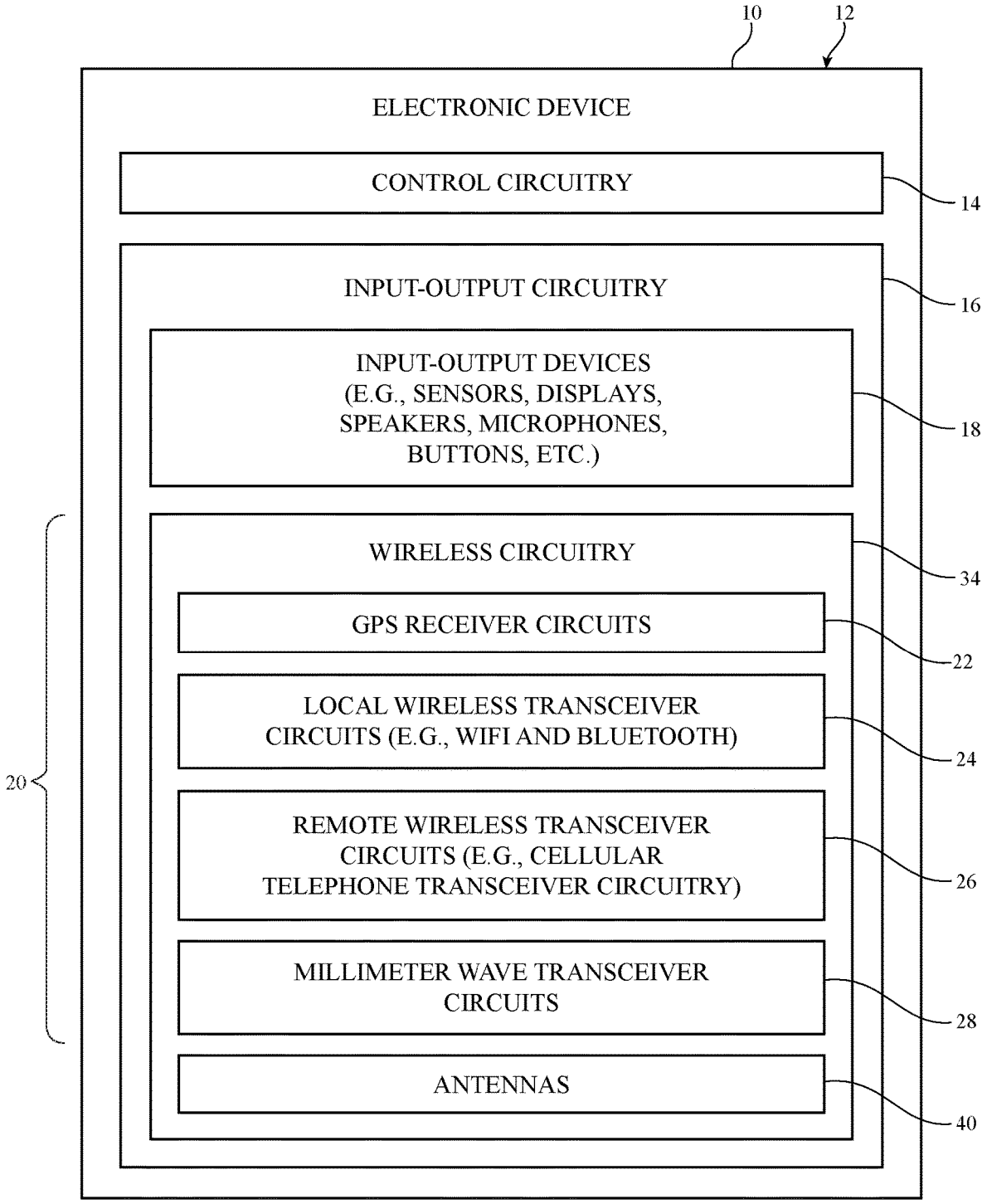
FIG. 2 is a schematic diagram of an illustrative electronic device with wireless communications circuitry in accordance with an embodiment.

A schematic diagram showing illustrative components that may be used in device 10 is shown in FIG. 2. As shown in FIG. 2, device 10 may include storage and processing circuitry such as control circuitry 14. Control circuitry 14 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 14 may be used to control the operation of device 10. This processing circuitry may be based on one or more microprocessors, microcontrollers, digital signal processors, baseband processor integrated circuits, application specific integrated circuits, etc.

Control circuitry 14 may be used to run software on device 10, such as internet browsing applications, voice-over-internet-protocol (VOIP) telephone call applications, email applications, media playback applications, operating system functions, etc. To support interactions with external equipment, control circuitry 14 may be used in implementing communications protocols. Communications protocols that may be implemented using control circuitry 14 include internet protocols, wireless local area network protocols (e.g., IEEE 802.11 protocols—sometimes referred to as WiFi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols, etc.

Device 10 may include input-output circuitry 16. Input-output circuitry 16 may include input-output devices 18. Input-output devices 18 may be used to allow data to be supplied to device 10 and to allow data to be provided from device 10 to external devices. Input-output devices 18 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 16 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas 40, transmission lines, and other circuitry for handling RF wireless signals. Wireless signals can also be sent using light (e.g., using infrared communications).

Wireless communications circuitry 34 may include transceiver circuitry 20 for handling various radio-frequency communications bands. For example, circuitry 34 may include transceiver circuitry 22, 24, 26, and 28.

Transceiver circuitry 24 may be wireless local area network (WLAN) transceiver circuitry. Transceiver circuitry 24 may handle 2.4 GHz and 5 GHz bands for WiFi® (IEEE 802.11) communications and may handle the 2.4 GHz Bluetooth® communications band.

Circuitry 34 may use cellular telephone transceiver circuitry 26 for handling wireless communications in frequency ranges such as a communications band from 700 to 960 MHz, a communications band from 1710 to 2170 MHz, and a communications from 2300 to 2700 MHz or other communications bands between 700 MHz and 4000 MHz or other suitable frequencies (as examples). Circuitry 26 may handle voice data and non-voice data.

Millimeter wave transceiver circuitry 28 (sometimes referred to as extremely high frequency (EHF) transceiver circuitry 28 or transceiver circuitry 28) may support communications at frequencies between about 10 GHz and 300 GHz. For example, transceiver circuitry 28 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, transceiver circuitry 28 may support communications in an IEEE K communications band between about 18 GHz and 27 GHz, a $K_a$ communications band between about 26.5 GHz and 40 GHz, a $K_u$ communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, circuitry 28 may support IEEE 802.11ad communications at 60 GHz and/or $5^{th}$ generation mobile networks or $5^{th}$ generation wireless systems (5G) communications bands between 27 GHz and 90 GHz. If desired, circuitry 28 may support communications at multiple frequency bands between 10 GHz and 300 GHz such as a first band from 27.5 GHz to 28.5 GHz, a second band from 37 GHz to 41 GHz, and a third band from 57 GHz to 71 GHz, or other communications bands between 10 GHz and 300 GHz. Circuitry 28 may be formed from one or more integrated circuits (e.g., multiple integrated circuits mounted on a common printed circuit in a system-in-package device, one or more integrated circuits mounted on different substrates, etc.). While circuitry 28 is sometimes referred to herein as millimeter wave transceiver circuitry 28, millimeter wave transceiver circuitry 28 may handle communications at any desired communications bands at frequencies between 10 GHz and 300 GHz (e.g., in millimeter wave communications bands, centimeter wave communications bands, etc.).

Wireless communications circuitry 34 may include satellite navigation system circuitry such as Global Positioning System (GPS) receiver circuitry 22 for receiving GPS signals at 1575 MHz or for handling other satellite positioning data (e.g., GLONASS signals at 1609 MHz). Satellite navigation system signals for receiver 22 are received from a constellation of satellites orbiting the earth.

In satellite navigation system links, cellular telephone links, and other long-range links, wireless signals are typically used to convey data over thousands of feet or miles. In WiFi® and Bluetooth® links at 2.4 and 5 GHz and other short-range wireless links, wireless signals are typically used to convey data over tens or hundreds of feet. Extremely high frequency (EHF) wireless transceiver circuitry 28 may convey signals over these short distances that travel between transmitter and receiver over a line-of-sight path. To enhance signal reception for millimeter and centimeter wave communications, phased antenna arrays and beam steering techniques may be used (e.g., schemes in which antenna signal phase and/or magnitude for each antenna in an array is adjusted to perform beam steering). Antenna diversity schemes may also be used to ensure that the antennas that have become blocked or that are otherwise degraded due to the operating environment of device 10 can be switched out of use and higher-performing antennas used in their place.

Wireless communications circuitry 34 can include circuitry for other short-range and long-range wireless links if desired. For example, wireless communications circuitry 34 may include circuitry for receiving television and radio signals, paging system transceivers, near field communications (NFC) circuitry, etc.

Antennas 40 in wireless communications circuitry 34 may be formed using any suitable antenna types. For example, antennas 40 may include antennas with resonating elements that are formed from loop antenna structures, patch antenna structures, inverted-F antenna structures, slot antenna structures, planar inverted-F antenna structures, monopoles, dipoles, helical antenna structures, Yagi (Yagi-Uda) antenna structures, hybrids of these designs, etc. If desired, one or more of antennas 40 may be cavity-backed antennas. Different types of antennas may be used for different bands and combinations of bands. For example, one type of antenna may be used in forming a local wireless link antenna and another type of antenna may be used in forming a remote wireless link antenna. Dedicated antennas may be used for receiving satellite navigation system signals or, if desired, antennas 40 can be configured to receive both satellite navigation system signals and signals for other communications bands (e.g., wireless local area network signals and/or cellular telephone signals). Antennas 40 can one or more antennas such as antennas arranged in one or more phased antenna arrays for handling millimeter and centimeter wave communications.

Transmission line paths may be used to route antenna signals within device 10. For example, transmission line paths may be used to couple antenna structures 40 to transceiver circuitry 20. Transmission lines in device 10 may include coaxial cable paths, microstrip transmission lines, stripline transmission lines, edge-coupled microstrip transmission lines, edge-coupled stripline transmission lines, waveguide structures, transmission lines formed from combinations of transmission lines of these types, etc. Filter circuitry, switching circuitry, impedance matching circuitry, and other circuitry may be interposed within the transmission lines, if desired.

In devices such as handheld devices, the presence of an external object such as the hand of a user or a table or other surface on which a device is resting has a potential to block wireless signals such as millimeter wave signals. Accordingly, it may be desirable to incorporate multiple antennas or phased antenna arrays into device 10, each of which is placed in a different location within device 10. With this type of arrangement, an unblocked antenna or phased antenna array may be switched into use. In scenarios where a phased antenna array is formed in device 10, once switched into use, the phased antenna array may use beam steering to optimize wireless performance. Configurations in which antennas from one or more different locations in device 10 are operated together may also be used.

Figure 3:
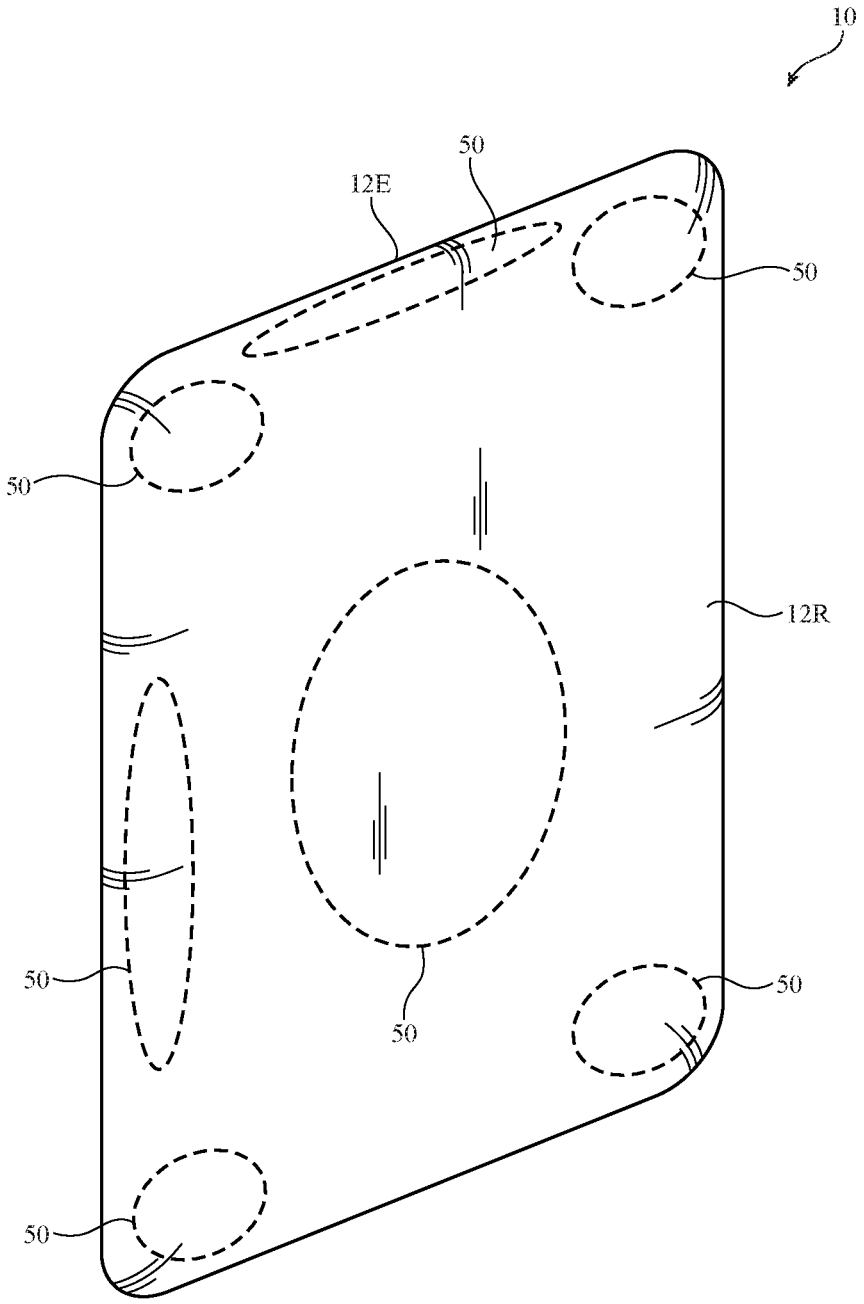
FIG. 3 is a rear perspective view of an illustrative electronic device showing illustrative locations at which antennas for communications at frequencies greater than 10 GHz may be located in accordance with an embodiment.

FIG. 3 is a perspective view of electronic device 10 showing illustrative locations 50 on the rear of housing 12 in which antennas 40 (e.g., single antennas and/or phased antenna arrays for use with wireless circuitry 34 such as wireless transceiver circuitry 28) may be mounted in device 10. Antennas 40 may be mounted at the corners of device 10, along the edges of housing 12 such as edge 12E, on upper and lower portions of rear housing portion (wall) 12R, in the center of rear housing wall 12R (e.g., under a dielectric window structure or other antenna window in the center of rear housing 12R), at the corners of rear housing wall 12R (e.g., on the upper left corner, upper right corner, lower left corner, and lower right corner of the rear of housing 12 and device 10), etc.

In configurations in which housing 12 is formed entirely or nearly entirely from a dielectric, antennas 40 may transmit and receive antenna signals through any suitable portion of the dielectric. In configurations in which housing 12 is formed from a conductive material such as metal, regions of the housing such as slots or other openings in the metal may be filled with plastic or other dielectric. Antennas 40 may be mounted in alignment with the dielectric in the openings. These openings, which may sometimes be referred to as dielectric antenna windows, dielectric gaps, dielectric-filled openings, dielectric-filled slots, elongated dielectric opening regions, etc., may allow antenna signals to be transmitted to external equipment from antennas 40 mounted within the interior of device 10 and may allow internal antennas 40 to receive antenna signals from external equipment. In another suitable arrangement, antennas 40 may be mounted on the exterior of conductive portions of housing 12.

In devices with phased antenna arrays, circuitry 34 may include gain and phase adjustment circuitry that is used in adjusting the signals associated with each antenna 40 in an array (e.g., to perform beam steering). Switching circuitry may be used to switch desired antennas 40 into and out of use. Each of locations 50 may include multiple antennas 40 (e.g., a set of three antennas or more than three or fewer than three antennas in a phased antenna array) and, if desired, one or more antennas from one of locations 50 may be used in transmitting and receiving signals while using one or more antennas from another of locations 50 in transmitting and receiving signals.

Figure 4:
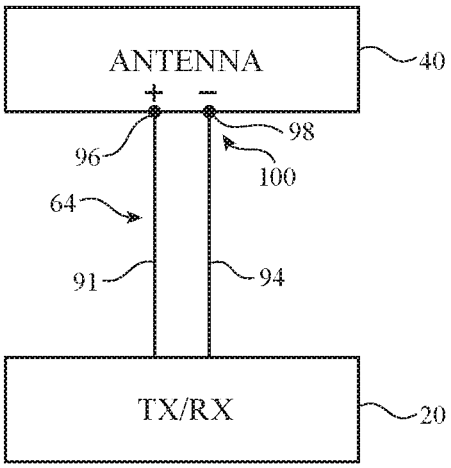
FIG. 4 is a diagram of an illustrative transceiver circuit and antenna in accordance with an embodiment.

A schematic diagram of an antenna 40 coupled to transceiver circuitry 20 (e.g., transceiver circuitry 28) is shown in FIG. 4. As shown in FIG. 4, radio-frequency transceiver circuitry 20 may be coupled to antenna feed 100 of antenna 40 using transmission line 64. Antenna feed 100 may include a positive antenna feed terminal such as positive antenna feed terminal 96 and may have a ground antenna feed terminal such as ground antenna feed terminal 98. Transmission line 64 may be formed form metal traces on a printed circuit or other conductive structures and may have a positive transmission line signal path such as path 91 that is coupled to terminal 96 and a ground transmission line signal path such as path 94 that is coupled to terminal 98. Transmission line paths such as path 64 may be used to route antenna signals within device 10. For example, transmission line paths may be used to couple antenna structures such as one or more antennas in an array of antennas to transceiver circuitry 20. Transmission lines in device 10 may include coaxial cable paths, microstrip transmission lines, stripline transmission lines, edge-coupled microstrip transmission lines, edge-coupled stripline transmission lines, waveguide structures, transmission lines formed from combinations of transmission lines of these types, etc. Filter circuitry, switching circuitry, impedance matching circuitry, and other circuitry may be interposed within transmission line 64 and/or circuits such as these may be incorporated into antenna 40 if desired (e.g., to support antenna tuning, to support operation in desired frequency bands, etc.).

Device 10 may contain multiple antennas 40. The antennas may be used together or one of the antennas may be switched into use while other antenna(s) are switched out of use. If desired, control circuitry 14 may be used to select an optimum antenna to use in device 10 in real time and/or to select an optimum setting for adjustable wireless circuitry associated with one or more of antennas 40. Antenna adjustments may be made to tune antennas to perform in desired frequency ranges, to perform beam steering with a phased antenna array, and to otherwise optimize antenna performance. Sensors may be incorporated into antennas 40 to gather sensor data in real time that is used in adjusting antennas 40.

In some configurations, antennas 40 may be arranged in one or more antenna arrays (e.g., phased antenna arrays to implement beam steering functions). For example, the antennas that are used in handling millimeter and centimeter wave signals for wireless transceiver circuits 28 may be implemented as phased antenna arrays. The radiating elements in a phased antenna array for supporting millimeter and centimeter wave communications may be patch antennas, dipole antennas, dipole antennas with directors and reflectors in addition to dipole antenna resonating elements (sometimes referred to as Yagi antennas or beam antennas), or other suitable antenna elements. Transceiver circuitry can be integrated with the phased antenna arrays to form integrated phased antenna array and transceiver circuit modules.

Figure 5:
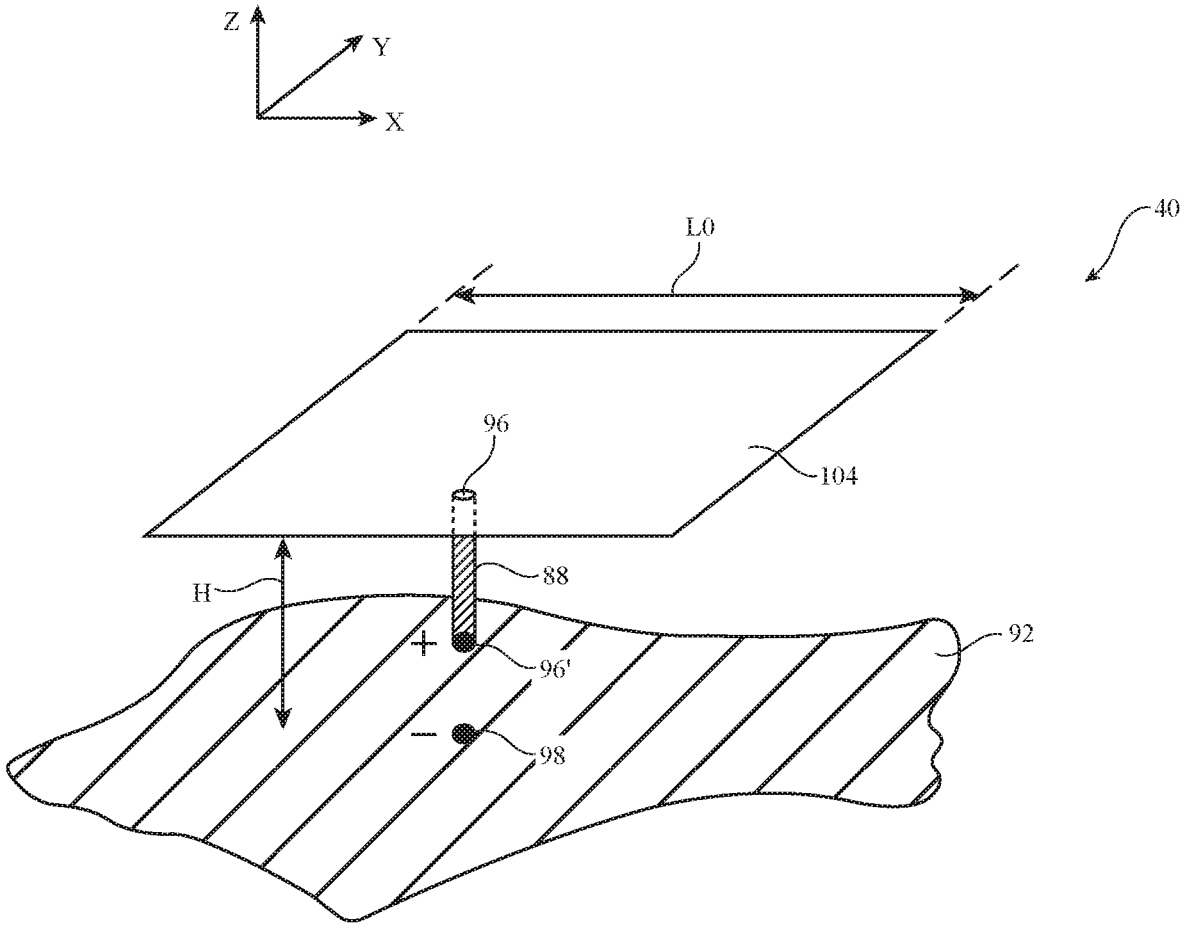
FIG. 5 is a perspective view of an illustrative patch antenna in accordance with an embodiment.

An illustrative patch antenna is shown in FIG. 5. As shown in FIG. 5, patch antenna 40 may have a patch antenna resonating element 104 that is separated from and parallel to a ground plane such as antenna ground plane 92. Positive antenna feed terminal 96 may be coupled to patch antenna resonating element 104. Ground antenna feed terminal 98 may be coupled to ground plane 92. If desired, conductive path 88 may be used to couple terminal 96' to terminal 96 so that antenna 40 is fed using a transmission line with a positive conductor coupled to terminal 96' and thus terminal 96. If desired, path 88 may be omitted. Other types of antenna feed arrangements may be used if desired. The illustrative feeding configuration of FIG. 5 is merely illustrative.

As shown in FIG. 5, patch antenna resonating element 104 may lie within a plane such as the X-Y plane of FIG. 5 (e.g., the lateral surface area of element 104 may lie in the X-Y plane). Patch antenna resonating element 104 may sometimes be referred to herein as patch 104, patch element 104, patch resonating element 104, or resonating element 104. Ground 92 may line within a plane that is parallel to the plane of patch 104. Patch 104 and ground 92 may therefore lie in separate parallel planes that are separated by a distance H. Patch 104 and ground 92 may be formed from conductive traces patterned on a dielectric substrate such as a rigid or flexible printed circuit board substrate, metal foil, stamped sheet metal, electronic device housing structures, or any other desired conductive structures. The length of the sides of patch 104 may be selected so that antenna 40 resonates at a desired operating frequency. For example, the sides of element 104 may each have a length L0 that is approximately equal to half of the wavelength (e.g., within 15% of half of the wavelength) of the signals conveyed by antenna 40 (e.g., in scenarios where patch element 104 is substantially square).

The example of FIG. 5 is merely illustrative. Patch 104 may have a square shape in which all of the sides of patch 104 are the same length or may have a different rectangular shape. If desired, patch 104 and ground 92 may have different shapes and orientations (e.g., planar shapes, curved patch shapes, patch shapes with non-rectangular outlines, shapes with straight edges such as squares, shapes with curved edges such as ovals and circles, shapes with combinations of curved and straight edges, etc.). In scenarios where patch 104 is non-rectangular, patch 104 may have a side or a maximum lateral dimension that is approximately equal to (e.g., within 15% of) half of the wavelength of operation, for example.

Figure 6:
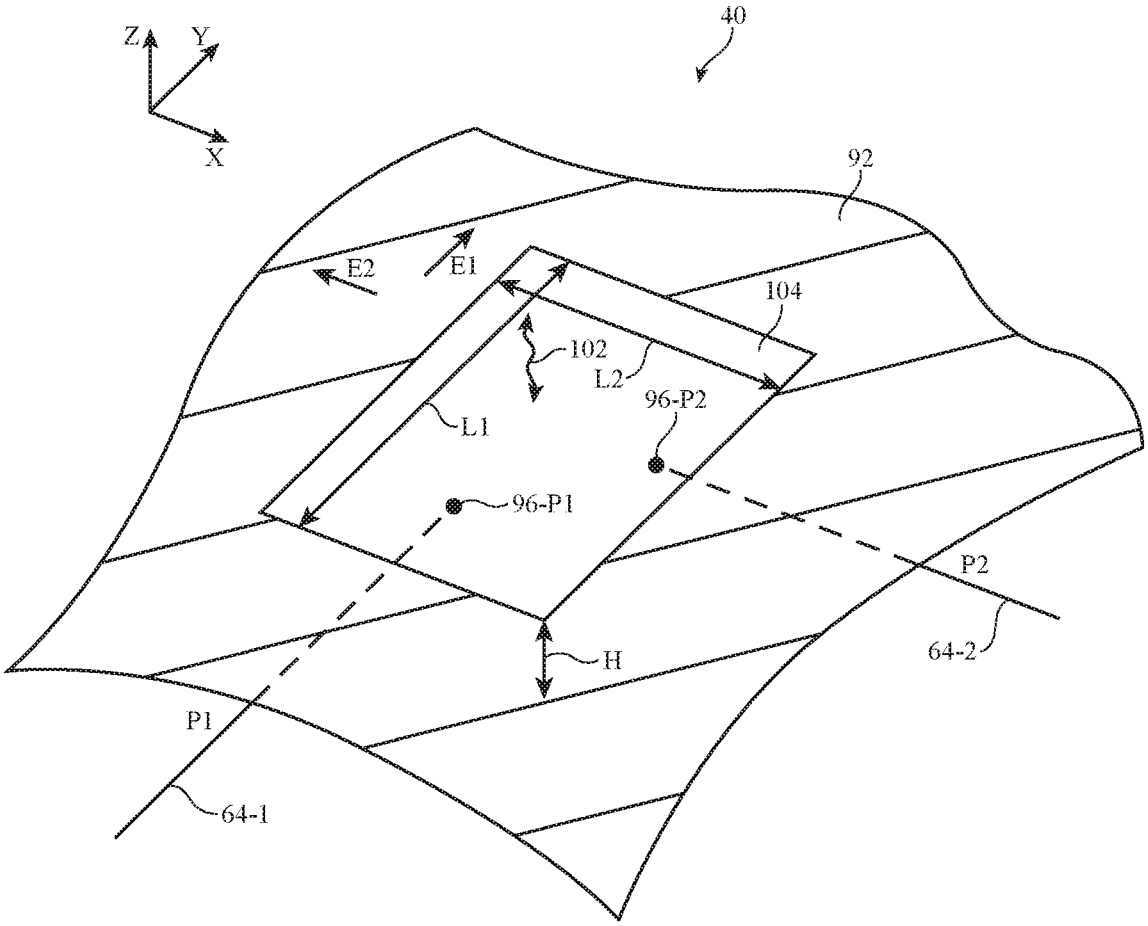
FIG. 6 is a perspective view of an illustrative patch antenna with dual ports in accordance with an embodiment.

To enhance the polarizations handled by patch antenna 40, antenna 40 may be provided with multiple feeds. An illustrative patch antenna with multiple feeds is shown in FIG. 6. As shown in FIG. 6, antenna 40 may have a first feed at antenna port P1 that is coupled to transmission line 64-1 and a second feed at antenna port P2 that is coupled to transmission line 64-2. The first antenna feed may have a first ground feed terminal coupled to ground 92 and a first positive feed terminal 96-P1 coupled to patch 104. The second antenna feed may have a second ground feed terminal coupled to ground 92 and a second positive feed terminal 96-P2 on patch 104.

Patch 104 may have a rectangular shape with a first pair of edges running parallel to dimension Y and a second pair of perpendicular edges running parallel to dimension X, for example. The length of patch 104 in dimension Y is L1 and the length of patch 104 in dimension X is L2. With this configuration, antenna 40 may be characterized by orthogonal polarizations.

When using the first antenna feed associated with port P1, antenna 40 may transmit and/or receive antenna signals in a first communications band at a first frequency (e.g., a frequency at which one-half of the corresponding wavelength is approximately equal to dimension L1). These signals may have a first polarization (e.g., the electric field E1 of antenna signals 102 associated with port P1 may be oriented parallel to dimension Y). When using the antenna feed associated with port P2, antenna 40 may transmit and/or receive antenna signals in a second communications band at a second frequency (e.g., a frequency at which one-half of the corresponding wavelength is approximately equal to dimension L2). These signals may have a second polarization (e.g., the electric field E2 of antenna signals 102 associated with port P2 may be oriented parallel to dimension X so that the polarizations associated with ports P1 and P2 are orthogonal to each other). In scenarios where patch 104 is square (e.g., length L1 is equal to length L2), ports P1 and P2 may cover the same communications band. In scenarios where patch 104 is rectangular, ports P1 and P2 may cover different communications bands if desired. During wireless communications using device 10, device 10 may use port P1, port P2, or both port P1 and P2 to transmit and/or receive signals (e.g., millimeter wave signals).

The example of FIG. 6 is merely illustrative. Patch 104 may have a square shape in which all of the sides of patch 104 are the same length or may have a rectangular shape in which length L1 is different from length L2. In general, patch 104 and ground 92 may have different shapes and orientations (e.g., planar shapes, curved patch shapes, patch element shapes with non-rectangular outlines, shapes with straight edges such as squares, shapes with curved edges such as ovals and circles, shapes with combinations of curved and straight edges, etc.). In scenarios where patch 104 is non-rectangular, patch 104 may have a side or a maximum lateral dimension (e.g., a longest side) that is approximately equal to (e.g., within 15% of) half of the wavelength of operation, for example.

Antennas 40 such as single-polarization patch antennas of the type shown in FIG. 5 and/or dual-polarization patch antennas of the type shown in FIG. 6 may be arranged within a corresponding phased antenna array in device 10 if desired. In practice, it may be desirable for antennas 40 within device 10 to be able to provide coverage in multiple communications bands between 10 GHz and 300 GHz. In one suitable arrangement, a first antenna 40 may provide coverage in a first communications band between 10 GHz and 300 GHz whereas a second antenna 40 provides coverage in a second communications band between 10 GHz and 300 GHz. As examples, the communications bands may include millimeter and/or centimeter wave frequencies from 27.5 GHz to 28.5 GHz, from 26 GHz to 30 GHz, from 20 to 36 GHz, from 37 GHz to 41 GHz, from 36 GHz to 42 GHz, from 30 GHz to 56 GHz, from 57 GHz to 71 GHz, from 58 GHz to 63 GHz, from 59 GHz to 61 GHz, from 42 GHz to 71 GHz, or any other desired bands of frequencies between 10 GHz and 300 GHz. As one example, the first communications band may include a $5^{th}$ generation mobile networks or $5^{th}$ generation wireless systems (5G) communication band between 27.5 GHz and 28.5 GHz whereas the second communications band includes a IEEE 802.11ad communications band from 57 GHz to 71 GHz. These examples are merely illustrative.

In some scenarios, a first antenna for covering the first communications band is formed at a first location and a second antenna for covering the second communications band is formed at a second location in the electronic device (e.g., first and second locations on opposing sides of the device). While a relatively large separation between the two antennas may enhance isolation between the antennas, forming the antennas at separate locations may occupy an excessive amount of the limited space within device 10. In order to reduce the amount of space required within device 10 for covering both the first and second frequency bands, the first antenna may be co-located with the second antenna in device 10. First and second antennas 40 may be considered to be co-located within device 10 when at least some of the antenna resonating element 104 of the first antenna overlaps the outline or footprint of the antenna resonating element 104 in the second antenna. Co-locating the antennas in this way may optimize the amount of space required by the antennas in device 10 for covering both the first and second communications bands.

Figure 7:
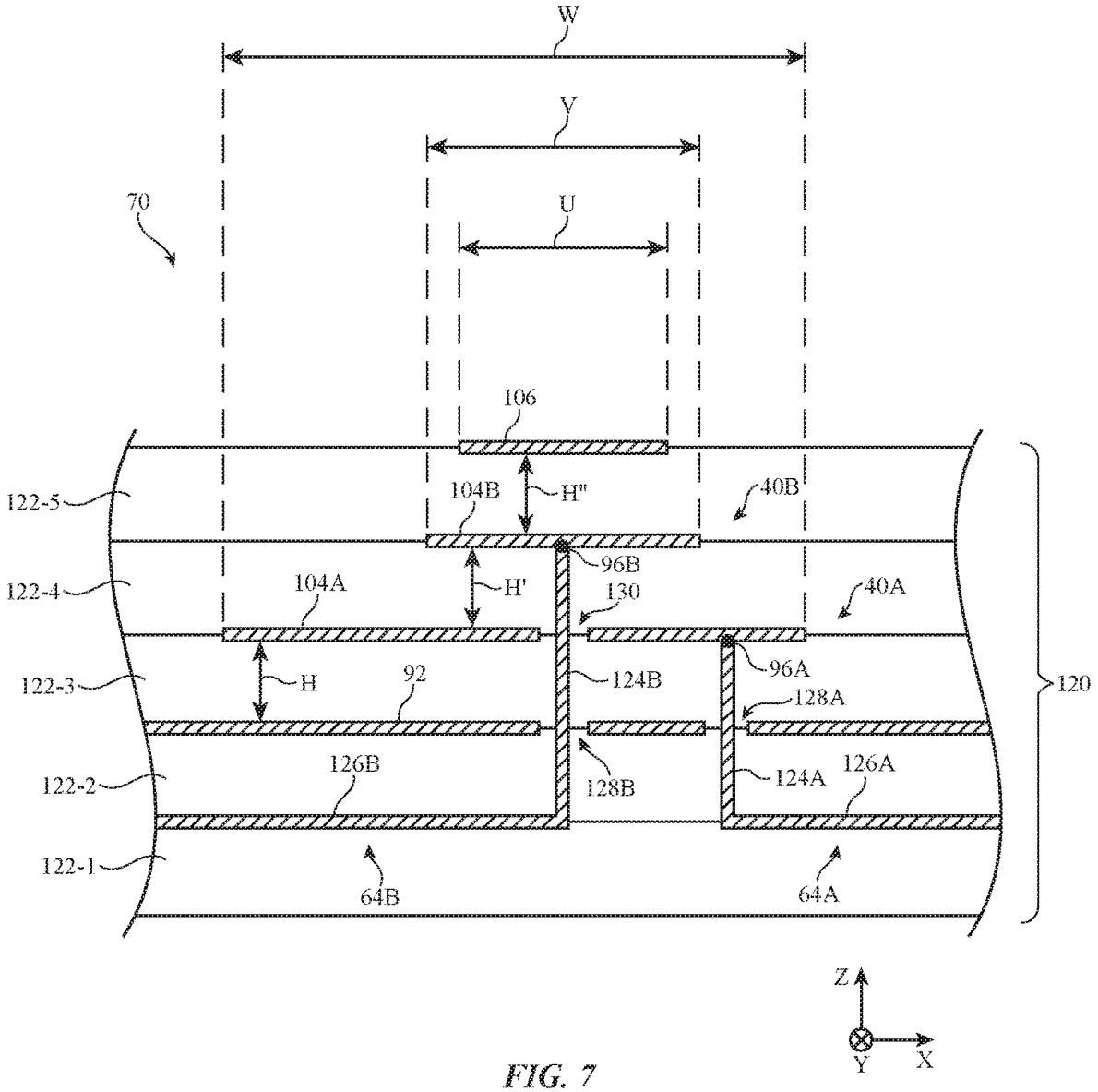
FIG. 7 is a cross-sectional side view of illustrative multi-band antenna structures including co-located patch antennas and a parasitic antenna resonating element in accordance with an embodiment.

FIG. 7 is a cross-sectional side view showing how a first antenna for covering the first communications band between 10 GHz and 300 GHz may be co-located with a second antenna for covering the second communications band between 10 GHz and 300 GHz. As shown in FIG. 7, antenna structures 70 may include a first antenna 40 such as antenna 40A and a second antenna 40 such as antenna 40B. Antenna 40A may cover the first communications band whereas antenna 40B covers the second communications band. Antenna structures 70 may collectively cover both the first and second communications bands. The second communications band covered by antenna 40B may include higher frequencies (e.g., frequencies between 57 GHz and 71 GHz) than the first communications band covered by antenna 40A (e.g., frequencies between 27.5 GHz and 28.5 GHz), for example.

In the example of FIG. 7, antenna 40A is a patch antenna such as the single-polarization patch antenna shown in FIG. 5 or the dual-polarization patch antenna shown in FIG. 6. Similarly, antenna 40B is a patch antenna such as the single-polarization patch antenna shown in FIG. 5 or the dual-polarization patch antenna shown in FIG. 6. This is merely illustrative and, if desired, antennas 40A and 40B may be formed using other antenna structures. Antenna structures 70 may sometimes be referred to herein as antenna system 70, multi-band antenna system 70, dual-band antenna system 70, multi-band antenna structures 70, patch antenna structures 70, multi-band patch antenna structures 70, co-located patch antenna structures 70, or co-located antenna structures 70. Antennas 40A and 40B may sometimes be referred to collectively herein as co-located antennas or co-located patch antennas 40A and 40B.

As shown in FIG. 7, patch antenna 40A may include patch antenna resonating element 104A, ground plane 92, and an antenna feed that includes a positive antenna feed terminal 96A coupled to patch antenna resonating element 104A and a corresponding ground antenna feed terminal coupled to ground plane 92. Patch antenna 40B may include patch antenna resonating element 104B, ground plane 92, and an antenna feed that includes a positive antenna feed terminal 96B coupled to patch antenna resonating element 104B and a corresponding ground antenna feed terminal coupled to ground plane 92.

Patch element 104A may have a lateral surface extending in the X-Y plane of FIG. 7 and may be separated from antenna ground plane 92 by distance H (e.g., the lateral surface of patch 104A may extend parallel to the lateral surface of ground plane 92). Patch element 104B may have a lateral surface extending in the X-Y plane and may be separated from patch element 104A by distance H' (e.g., the lateral surface of patch 104B may extend parallel to the lateral surface of ground plane 92 and patch 104A). Distance H' may be the same as distance H, less than distance H, or greater than distance H (e.g., patch 104B may be separated from ground plane 92 by distance H+H'). Patch element 104B may, for example, serve to reflect some of the antenna signals radiated by patch 104A if desired. Distances H and H' may be between 0.1 mm and 10 mm, as examples. In general, adjusting distances H and H' may serve to adjust the bandwidth of antennas 40A and 40B, respectively.

Antennas 40A and 40B may be formed on a dielectric substrate such as substrate 120. Substrate 120 may be, for example, a rigid or printed circuit board or other dielectric substrate. Substrate 120 may include multiple dielectric layers 122 (e.g., multiple layers of printed circuit board substrate such as multiple layers of fiberglass-filled epoxy) such as a first dielectric layer 122-1, a second dielectric layer 122-2 over the first dielectric layer, a third dielectric layer 122-3 over the second dielectric layer, a fourth dielectric layer 122-4 over the third dielectric layer, and a fifth dielectric layer 122-5 over the fourth dielectric layer. Additional dielectric layers 122 may be stacked within substrate 120 if desired.

With this type of arrangement, antenna 40A may be embedded within the layers of substrate 120. For example, ground plane 92 may be formed on a surface of second layer 122-2 whereas patch antenna resonating element 104A is formed on a surface of third layer 122-3. Antenna 40A may be fed using a first transmission line such as transmission line 64A. Transmission line 64A may, for example, be formed from a conductive trace such as conductive trace 126A on layer 122-1 and portions of ground layer 92. Conductive trace 126A may form the positive signal conductor for transmission line 64A, for example. A first hole 128A may be formed in ground layer 92. First transmission line 64A may include a vertical conductor 124A (e.g., a conductive through-via, metal pillar, metal wire, conductive pin, or other vertical conductive interconnect structures) that extends from trace 126A through layer 122-2, hole 128A in ground layer 92, and layer 122-3 to antenna feed terminal 96A on patch element 104A. This example is merely illustrative and, if desired, other transmission line structures may be used (e.g., coaxial cable structures, stripline transmission line structures, etc.).

Patch antenna 40B may be embedded within the layers of substrate 120. For example, patch antenna resonating element 104B may be formed on a surface of dielectric layer 122-4. Some or all of the lateral area of patch antenna resonating element 104B may overlap with the outline (footprint) of patch antenna resonating element 104A (in the X-Y plane). Antenna 40B may be fed using a second transmission line such as transmission line 64B. Transmission line 64B may, for example, be formed from a conductive trace such as conductive trace 126B on layer 122-1 and portions of ground layer 92. Conductive trace 126B may form the positive signal conductor for transmission line 64B, for example. A second hole 128B may be formed in ground layer 92. A hole 130 may be formed in patch antenna resonating element 104A. Second transmission line 64B may include a vertical conductor 124B (e.g., a conductive through-via, metal pillar, metal wire, conductive pin, or other vertical conductive interconnect structures) that extends from trace 126B through layer 122-2, hole 128B in ground layer 92, layer 122-3, opening 130 in patch element 104A, and layer 122-4 to antenna feed terminal 96B on patch element 104B. This example is merely illustrative and, if desired, other transmission line structures may be used (e.g., coaxial cable structures, stripline transmission line structures, etc.). Transmission line traces 126A and 126B may be formed on different layers 122 if desired. Vertical conductors 124A and 124B may extend through the same hole in ground plane 92 if desired. Holes 128A and 128B may sometimes be referred to herein as notches, gaps, openings, or slots.

In practice, patch element 104B alone may have insufficient bandwidth for covering an entirety of the second communications band (e.g., an entirety of the frequency range from 57 GHz to 71 GHz). If desired, antenna 40B may include one or more parasitic antenna resonating elements that serve to broaden the bandwidth of antenna 40B.

As shown in FIG. 7, antenna 40B may include a parasitic antenna resonating element such as parasitic antenna resonating element 106. Parasitic antenna resonating element 106 may be formed on a surface of dielectric layer 122-5. Parasitic antenna resonating element 106 may have a lateral surface area extending in the X-Y plane of FIG. 7 and may be separated from patch element 104B by distance H". Distance H" may be the same as distance H, less than distance H, or greater than distance H (e.g., parasitic 106 may be separated from ground plane 92 by distance H+H'+H" and may be separated from patch 104B by distance H'+H"). Distance H" may be between 0.1 mm and 10 mm, as an example. In general, adjusting distance H" may serve to adjust the bandwidth of antenna 40B, for example. Some or all of the lateral area of patch antenna resonating element 106 may overlap with the outline (footprint) of patch antenna resonating element 104B (in the X-Y plane).

Parasitic antenna resonating element 106 may be formed from conductive traces patterned onto a surface of layer 122-4, from stamped sheet metal, metal foil, electronic device housing structures, or any other desired conductive structures. Parasitic antenna resonating element 106 may sometimes be referred to herein as parasitic resonating element 106, parasitic antenna element 106, parasitic element 106, parasitic patch 106, parasitic conductor 106, parasitic structure 106, patch 106, or parasitic 106. Parasitic element 106 is not directly fed (e.g., element 106 is not electrically connected to any transmission lines 64), whereas patch antenna resonating element 104B is directly fed via transmission line 64B and feed terminal 96B and patch antenna resonating element 104A is directly fed via transmission line 64A and feed terminal 96A. Parasitic element 106 may create a constructive perturbation of the electromagnetic field generated by patch antenna resonating element 104B, creating a new resonance for antenna 40B. This may serve to broaden the overall bandwidth of antenna 40B (e.g., to cover the entire frequency band from 57 GHz to 71 GHz).

As shown in FIG. 7, patch element 104A may have a width W. As examples, patch element 104A may be a rectangular patch (e.g., as shown in FIGS. 5 and 6) having a side of length W, a square patch having four sides of length W, a circular patch having diameter W, an elliptical patch having a major axis length W, or may have any other desired shape (e.g., where width W is the maximum lateral dimension of the patch, the length of a side of a polygonal patch, the length of the longest side of a polygonal patch, the length of a side of a rectangular footprint of the patch, etc.). Patch element 104B may have a width V. As examples, patch element 104B may be a rectangular patch (e.g., as shown in FIGS. 5 and 6) having a side of length V, a square patch having four sides of length V, a circular patch having diameter V, an elliptical patch having a major axis length V, or may have any other desired shape (e.g., where width V is the maximum lateral dimension of the patch, the length of a side of a polygonal patch, the length of the longest side of a polygonal patch, the length of a side of a rectangular footprint of the patch, etc.). Width V may be inversely proportional to the frequency of operation of antenna 40B whereas width W is inversely proportional to the frequency of operation of antenna 40A.

Because antenna 40B is used to cover higher frequencies than antenna 40A in the example of FIG. 7, width W may be greater than width V. As an example, width W may be approximately equal to twice width V (e.g., width W may be between 1.7 and 2.3 times width V, between 1.8 and 2.2 times width V, twice width V, etc.). Width W of patch 104A may be approximately equal to half of the wavelength of operation of antenna 40A. Width V of patch 104B may be approximately equal to half of the wavelength of operation of antenna 40B. In practice, widths W and V may depend upon the dielectric constant of dielectric substrate 120 (e.g., widths W and V may be inversely proportional to the dielectric constant of substrate 120). As an example, when antenna 40A is configured to cover a first communications band from 27.5 GHz to 28.5 GHz and antenna 40B is configured to cover a second communications band from 57 GHz to 71 GHz, width W may be approximately equal to 1.1-2.5 mm for covering the first communications band whereas width V is approximately equal to 0.5-1.25 mm for covering the second communications band.

Parasitic element 106 may have a width U. As examples, parasitic element 106 may be a rectangular patch having a side of length U, a square patch having sides of length U, a circular patch having diameter U, an elliptical patch having a major axis length U, a cross-shape having a maximum lateral dimension or a rectangular footprint with a side of length U, or may have any other desired shape (e.g., where width U is the maximum lateral dimension of the patch, the length of a side of a polygonal patch, the length of the longest side of a polygonal patch, the length of a side of a rectangular footprint of the patch, etc.). Width U may be less than, greater than, or equal to width V. In one suitable arrangement, width U is less than or equal to width V (e.g., between 0.05 mm and 1.25 mm).

The example of FIG. 7 is merely illustrative. If desired, additional layers 122 may be interposed between traces 126A and 126B and ground layer 92, between ground layer 92 and patch 104A, between patch 104A and patch 104B, and/or between patch 104B and parasitic 106. In another suitable arrangement, substrate 120 may be formed from a single dielectric layer (e.g., antennas 40A and 40B may be embedded within a single dielectric layer such as a molded plastic layer). In yet another suitable arrangement, substrate 120 may be omitted and antennas 40A and 40B may be formed on other substrate structures or may be formed without substrates.

In the example of FIG. 7, antennas 40A and 40B are shown as having only a single feed for the sake of simplicity. In order to enhance the polarizations covered by antenna structures 70, antennas 40A and/or 40B may be dual-polarized patch antennas that each have two corresponding feeds (e.g., as shown in FIG. 6, such that structures 70 have a combined total of four antenna feeds), suitable geometry, and suitable phasing of ports P1 and P2.

Figure 8:
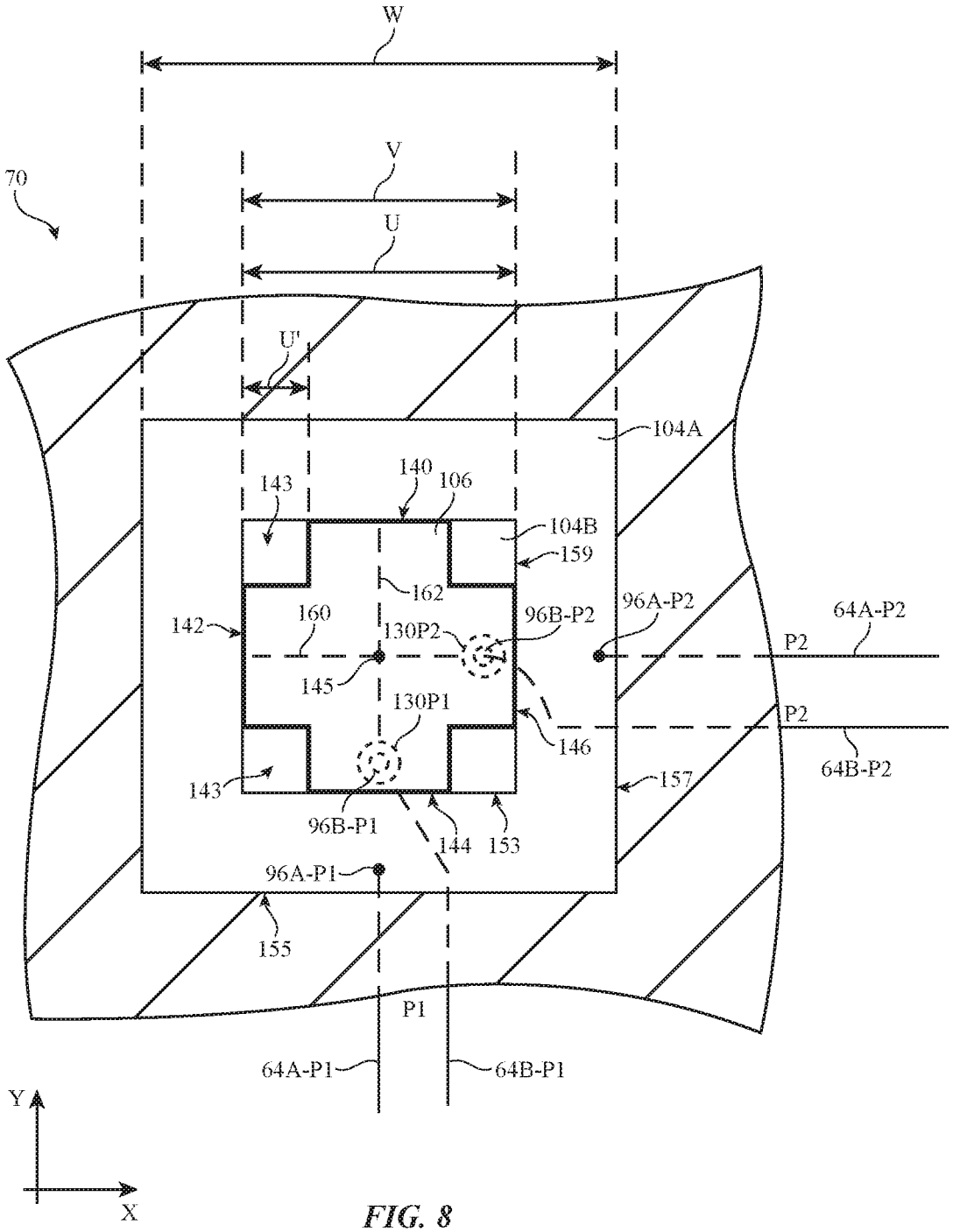
FIG. 8 is a top-down view of illustrative multi-band antenna structures including co-located patch antennas and a parasitic antenna resonating element in accordance with an embodiment.

FIG. 8 is a top-down view showing how antenna structures 70 may include patch antennas 40A and 40B that each have two feeds (e.g., for covering multiple or non-linear polarizations). In the example of FIG. 8, dielectric 122 is not shown for the sake of clarity. As shown in FIG. 8, antenna 40A may have a first feed at antenna port P1 that is coupled to a first transmission line 64A-P1 and a second feed at antenna port P2 that is coupled to a second transmission line 64A-P2. The first feed may include a first ground feed terminal coupled to ground plane 92 and a first positive feed terminal 96A-P1 coupled to patch antenna resonating element 104A at a first location on patch antenna resonating element 104A. The second antenna feed may include a second ground feed terminal coupled to ground plane 92 and a second positive feed terminal 96A-P2 coupled to patch antenna resonating element 104A at a second location on patch antenna resonating element 104A. For example, the location of first feed terminal 96A-P1 may be adjacent to a first side 155 of patch 104A (e.g., approximately halfway across width W of patch 104A) whereas the location of second feed terminal 96A-P2 is adjacent to a second side 157 of patch 104A (e.g., approximately halfway across the length of side 157).

Antenna 40B may have a third feed at antenna port P1 that is coupled to a third transmission line 64B-P1 and a fourth feed at antenna port P2 that is coupled to a fourth transmission line 64B-P2. The third feed may include a third ground feed terminal coupled to ground plane 92 and a third positive feed terminal 96B-P1 coupled to patch antenna resonating element 104B at a first location on patch antenna resonating element 104B (e.g., adjacent to side 153 of patch 104B approximately halfway across the width V of patch 104B). The fourth antenna feed may include a fourth ground feed terminal coupled to ground plane 92 and a fourth positive feed terminal 96B-P2 coupled to patch antenna resonating element 104B at a second location on patch antenna resonating element 104B (e.g., adjacent to side 159 of patch 104B approximately halfway across side 159).

Parasitic resonating element 106 may be formed over patch 104B. At least some or an entirety of parasitic resonating element 106 may overlap patch 104B. In the example of FIG. 8, parasitic resonating element 106 has a cross or "X" shape. In order to form the cross shape, parasitic element 106 may include notches or slots such as slots 143 (e.g., slots formed by removing conductive material from the corners of a square or rectangular metal patch). Cross-shaped parasitic 106 may have a rectangular (e.g., square) footprint. The width U of cross-shaped parasitic element 106 may be defined by the length of a side of the rectangular footprint of element 106, for example.

Cross-shaped parasitic resonating element 106 may include a first arm 140, a second arm 142, a third arm 144, and a fourth arm 146 that extend from the center point 145 of element 106. First arm 140 may oppose third arm 144 whereas second arm 142 opposes fourth arm 146 (e.g., arms 140 and 144 may extend in parallel and from opposing sides of center point 145 of element 106 and arms 142 and 146 may extend in parallel and from opposing sides of center point 145). Arms 142 and 146 may extend along a first longitudinal axis 160 whereas arms 140 and 144 extend along a second longitudinal axis 162. Longitudinal axis 160 may be oriented at a non-parallel angle with respect to longitudinal axis 162 (e.g., an angle between 0 degrees and 180 degrees). As an example, axis 160 may be oriented at approximately 90 degrees with respect to axis 162. In the example of FIG. 8, the combined length of arms 140 and 144 is equal to the combined length of arms 142 and 146 (e.g., each of arms 140, 142, 144, and 146 has the same length).

In a single-polarization patch antenna, the distance between the positive antenna feed terminal 96 and the edge of patch 104 may be adjusted to ensure that there is a satisfactory impedance match between patch 104 and the corresponding transmission line 64. However, such impedance adjustments may not be possible when the antenna is a dual-polarized patch antenna having two feeds. Removing conductive material from parasitic resonating element 106 to form notches 143 may serve to adjust the impedance of patch 104B so that the impedance of patch 104B is matched to both transmission lines 64B-P1 and 64B-P2, for example. Notches 143 may therefore sometimes be referred to herein as impedance matching notches, impedance matching slots, or impedance matching structures.

The dimensions of impedance matching notches 143 may be adjusted (e.g., during manufacture of device 10) to ensure that antenna 40B is sufficiently matched to both transmission lines 64B-P1 and 64B-P2 and to tweak the overall bandwidth of antenna 40B. As an example, notches 143 may have sides with lengths U' that are equal to between 1% and 45% of dimension U of parasitic 106. In an example where width U is between 1.0 mm and 1.2 mm, length U' may be between 0.3 mm and 0.4 mm, for example. In order for antenna 40B to be sufficiently matched to transmission lines 64B-P1 and 64B-P2, feed terminals 96B-P1 and 96B-P2 need to overlap with the conductive material of parasitic element 106. Notches 143 may therefore be sufficiently small so as not to uncover feed terminals 96B-P1 or 96B-P2. In other words, each of antenna feed terminals 96B-P1 and 96B-P2 may overlap with a respective arm of the cross-shaped parasitic antenna resonating element 106. During wireless communications using device 10, device 10 may use ports P1 and P2 to transmit and/or receive wireless wave signals with two orthogonal linear polarizations or with a circular or elliptical polarization. The example of FIG. 8 is merely illustrative. If desired, parasitic antenna resonating element 106 may have additional notches 143, fewer notches 143, may have curved edges, straight edges, combinations of straight and curved edges, or any other desired shape.

Because arms 144 and 146 need to overlap feed terminals 96B-P1 and 96B-P2 on patch 104B, parasitic 106 may be oriented to align with patch 104B such that the ends of parasitic arms 142 and 146 are parallel to edge 159 of patch 104B and the ends of parasitic arms 140 and 144 are approximately parallel to edge 153 of patch 104B (e.g., longitudinal axis 162 of parasitic 106 may be oriented between at an angle between 0 and 10 degrees with respect to edge 159 of patch 104B whereas longitudinal axis 160 of parasitic 106 may be oriented at an angle between 0 and 10 degrees with respect to edge 153 of patch 104B). In the example of FIG. 8, longitudinal axis 160 of parasitic 106 and edge 153 of patch 104B are parallel to edge 155 of patch 104A and longitudinal axis 162 of parasitic 106 and edge 159 of patch 104B are parallel to edge 157 of patch 104A. However, this is merely illustrative. If desired, parasitic 106 and patch 104B may be rotated with respect to patch 104A (e.g., so long as the arms of parasitic 106 remain parallel to two sides of patch 104B so that the polarizations associated with ports P1 and P2 do not mix). For example, longitudinal axis 160 and side 153 may be rotated at any desired angle between 0 degrees and 360 degrees with respect to edge 155 of patch 104A. Similarly, longitudinal axis 162 and side 159 may be rotated at any desired angle between 0 degrees and 360 degrees with respect to edge 157 of patch 104A. In this way, antenna 40B may have any desired polarization rotated with respect to the polarizations of antenna 40A.

One or more openings 130 may be provided in patch 104A to accommodate feed terminals 96B-P1 and 96B-P2 on patch 104B. In the example of FIG. 8, a first opening 130P1 is formed in patch 104A for accommodating feed 96B-P1 (e.g., a corresponding vertical conductor 128B as shown in FIG. 7 may pass through opening 130P1 to feed terminal 96B-P1) and a second opening 130P2 is formed in patch 104A for accommodating feed 96B-P2 (e.g., a corresponding vertical conductor 128B may pass through opening 130P2 to feed terminal 96B-P2). In another suitable arrangement, a single opening 130 may be formed in patch 104A for accommodating both feed terminals 96B-P1 and 96B-P2 (e.g., both vertical conductors 128B may pass through the same hole 130). As one example, a single cross-shaped opening may be formed in patch 104A. The cross-shaped opening may have first and second opposing arms that have a longitudinal axis that runs between feed terminals 96A-P2 and 96A-P1 (e.g., oriented at an angle between 0 and 90 degrees such as 45 degrees with respect to axes 160 and 162 in FIG. 8). When configured in this way, the cross-shaped opening may serve to enhance isolation between feed terminals 96A-P2 and 96A-P1 on patch 104A. This is merely illustrative and, in general, opening 130 may have any desired shape.

In the example of FIG. 8, patches 104A and 104B are both square patches oriented in the same direction and centered on the same point. This is merely illustrative and, in other scenarios, patches 104A and 104B may have other shapes or orientations. Parasitic element 106 may include fewer or more than four arms if desired. In general, parasitic 106 may be referred to herein as a cross-shaped parasitic element in any scenario where parasitic 106 includes at least three arms extending from different sides of a common point on parasitic 106, where the arms of parasitic 106 extend along at least two non-parallel longitudinal axes. Similarly, opening 130 may be referred to herein as a cross-shaped opening in any scenario where opening 130 includes at least three arms extending from different sides of a common point within the opening, where the arms of the opening extend along at least two non-parallel longitudinal axes.

Figure 9:
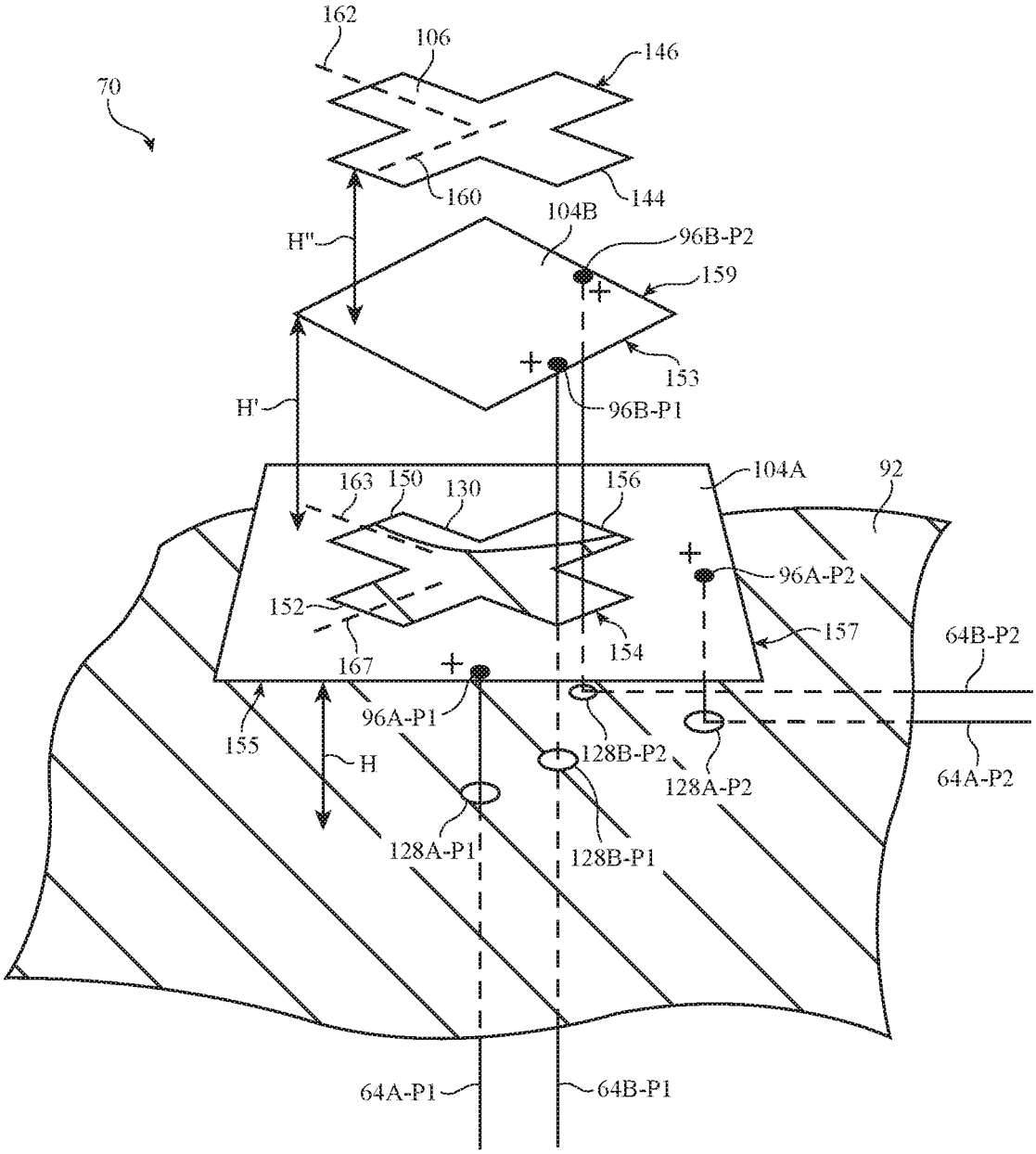
FIG. 9 is a perspective view of illustrative multi-band antenna structures including co-located patch antennas and a parasitic antenna resonating element in accordance with an embodiment.

FIG. 9 is a perspective view of multi-band antenna structures 70 having a single cross-shaped opening 130 in patch 104A. In the example of FIG. 9, dielectric 122 is not shown for the sake of clarity. As shown in FIG. 9, patch element 104A may be formed at distance H above ground plane 92. Patch element 104B may be formed at distance H' above patch 104A. Parasitic element 106 may be formed at distance H" above patch 104B.

A single cross-shaped opening 130 may be formed in patch 104A. Cross-shaped opening 130 may have a first arm 150, a second arm 152, a third arm 154, and a fourth arm 156 that extend from the center of opening 130 (e.g., from the center of patch 104A). Arm 154 may be interposed between the location of feed terminal 96A-P1 and the location of feed terminal 96A-P2 and may serve to isolate terminals 96A-P1 and 96A-P2. Opening 130 may, for example, be a closed slot that is completely surrounded by the conductive material in patch 104A (e.g., the conductive material in patch 104A may define all of the edges of opening 130). First arm 150 may oppose third arm 154 whereas second arm 152 opposes fourth arm 156. Arms 150 and 154 may both extend along longitudinal axis 163 (e.g., from opposing sides of the center of patch 104A) whereas arms 152 and 156 extend along longitudinal axis 167.

Patch 104B and parasitic 106 may be rotated with respect to patch 104A. In the example of FIG. 9, patch 104B and parasitic 106 have been rotated to align with two of the arms of opening 130 (e.g., so that arm 156 of opening 130 overlaps the location of feed terminal 96B-P2 on patch 104B and arm 144 of parasitic 106 and arm 154 of opening 130 overlaps the location of feed terminal 96B-P1 on patch 104B and arm 146 of parasitic 106). This example is merely illustrative. In general, parasitic 106 and patch 104B may be rotated at any desired angle with respect to patch 104A. If desired, cross-shaped opening 130 may be rotated (misaligned) with respect to cross-shaped parasitic 106 (e.g., longitudinal axis 163 may be rotated at an angle between 0 degrees and 90 degrees with respect to axis 162 and axis 167 may be rotated at an angle between 0 degrees and 90 degrees with respect to axis 160). By rotating parasitic 106 and patch 104B in this way, opening 130 may serve to isolate feed terminals 96A-P1 and 96A-P2 while also accommodating vertical conductors 124 for both feed terminals 96B-P1 and 96B-P2 of patch 104B.

A first hole 128A-P1, a second hole 128B-P1, a third hole 128A-P2, and a fourth hole 128B-P2 may be formed in ground plane 92. Transmission line 64A-P1 (e.g., the corresponding vertical conductor 124 as shown in FIG. 7) may extend through hole 128A-P1 to feed terminal 96A-P1 on patch 104A. Transmission line 64B-P1 (e.g., the corresponding vertical conductor 124) may extend through hole 128B-P1 in ground plane 92 and through arm 154 of opening 130 to feed terminal 96B-P1 on patch 104B. Feed terminal 96B-P1 may be overlapped by (e.g., may be located directly beneath or within the lateral outline of) arm 144 of parasitic element 106. Transmission line 64A-P2 (e.g., the corresponding vertical conductor 124) may extend through hole 128A-P2 to feed terminal 96A-P2 on patch 104A. Transmission line 64B-P2 (e.g., the corresponding vertical conductor 124) may extend through hole 128B-P2 in ground plane 92 and arm 156 of opening 130 to feed terminal 96B-P on patch element 104B. Feed terminal 96B-P2 may be overlapped by arm 146 of parasitic element 106.

In this way, cross-shaped opening 130, which enhances the isolation between feed terminals 96A-P2 and 96A-P1 may allow both transmission lines 64B-P2 and 64B-P1 to pass through patch element 104A (e.g., without shorting to the conductive material in element 104A), while parasitic antenna resonating element 106 serves to both broaden the bandwidth of antenna 40B and impedance match patch 104B to both transmission lines 64B-P1 and 64B-P2. By stacking antennas 40A and 40B in this way, the amount of space required to cover both communications bands may be reduced relative to scenarios where antennas 40A and 40B are formed at separate locations in device 10.

Transmission lines 64A-P1, 64A-P2, 64B-P1, and 64B-P2 may include conductive traces 126 formed on a single dielectric layer 122 (e.g., layer 122-1 of FIG. 7) or may be formed on two or more different dielectric layers. If desired, two or more of transmission lines 64A-P1, 64A-P2, 64B-P1, and 64B-P2 may pass through the same opening in ground plane 92. The example of FIG. 9 is merely illustrative. In general, parasitic element 106, patch 104B, patch 104A, and ground 92 may have any desired shapes, relative placements, and relative orientations. Opening 130 may have any desired shape having curved and/or straight edges. If desired, separate openings 130 may be provided in patch 104A for accommodating feed terminals 96B-P1 and 96B-P2 (e.g., openings 130P1 and 130P2 as shown in FIG. 8). Parasitic 106 and patch 104B may be rotated at any desired angle with respect to patch 104A.

Figure 10:
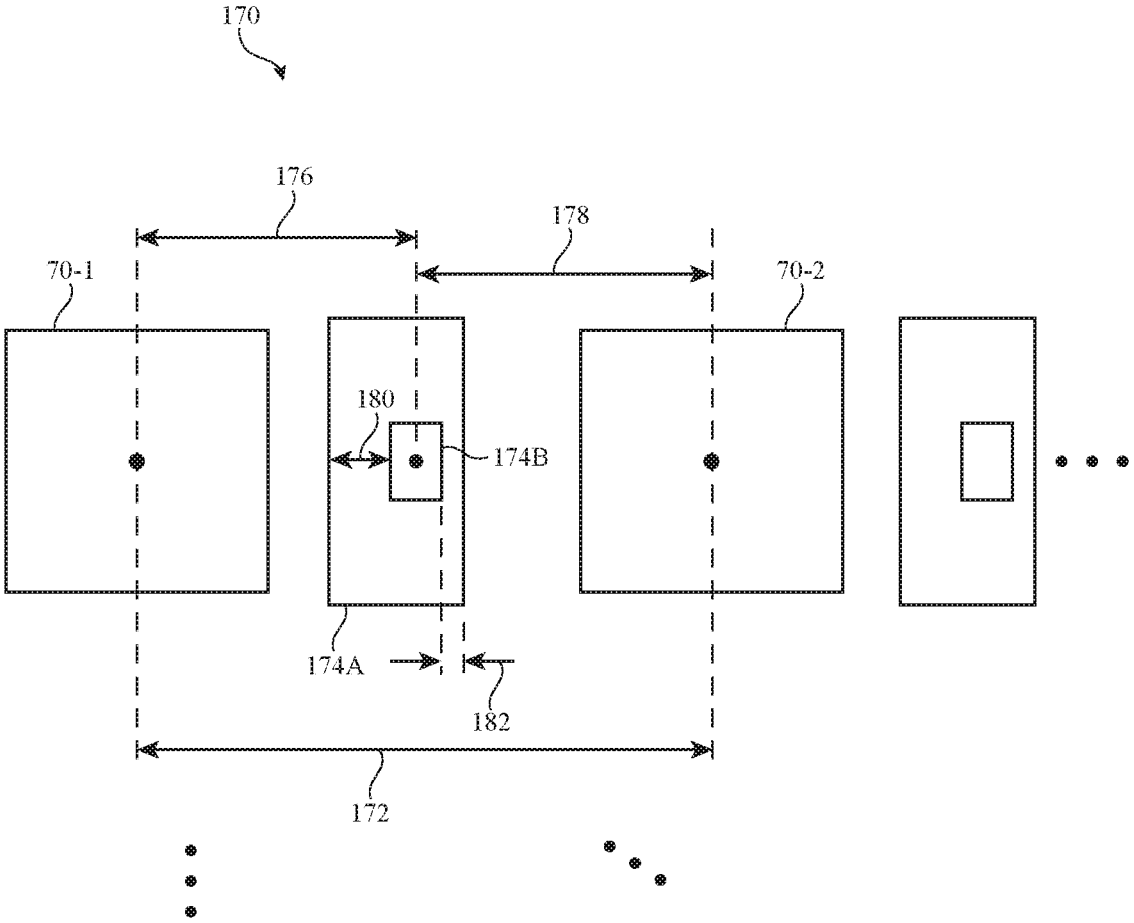
FIGS. 10 and 11 are top-down views of a phased antenna array including antennas of the type shown in FIGS. 5-9 and non-radiative elements in accordance with an embodiment.

FIG. 10 is a top-down view showing one example of how antenna structures 70 of FIGS. 7-9 may be arranged within a phased antenna array. As shown in FIG. 10, multiple antenna structures 70 (e.g., first multi-band antenna structures 70-1 including a first co-located pair of antennas 40A and 40B, second multi-band antenna structures 70-2 including a second co-located pair of antennas 40A and 40B, etc.) may be arranged in a grid pattern (e.g., a rectangular grid having rows or columns or in any other desired array pattern). First antenna structures 70-1 may be located at a distance 172 with respect to second antenna structures 70-2. Distance 172 may be approximately equal to half of the wavelength of operation of the antennas 40A in structures 70-1 and 70-2. As an example, distance 172 may be between 4 mm and 6 mm (e.g., approximately 5 mm). Separating structures 70-1 and 70-2 in this way may allow for array 170 to perform beam scanning operations without generating grating lobes in the radiation pattern of array 170. The presence of excessive grating lobes may result in excessive coupling between structures 70-1 and 70-2 and reduce the overall antenna efficiency of array 170, for example.

One or more parasitic elements 174 may be interposed between each pair of antenna structures 70 in array 170 to enhance isolation (decoupling) between adjacent structures 70 if desired. In the example of FIG. 10, first parasitic element 174A and second parasitic element 174B are interposed between antenna structures 70-1 and antenna structures 70-2. Parasitic element 174A may be an un-fed, non-radiative conductive patch. Parasitic element 174A may be, for example, a rectangular conductive patch or a conductive patch having any other desired shape. Parasitic element 174A may be located closer to structures 70-1 than structures 70-2 in one suitable arrangement. In general, element 174A may be formed at any desired location between structures 70-1 and 70-2. If desired, parasitic element 174A may be formed from conductive traces, stamped sheet metal, metal foil, metal electronic device housing structures, or other conductive structures on the same dielectric layer of substrate 120 as patches 104A (e.g., layer 122-3 of FIG. 7), on a different dielectric layer from patches 104A, or may be formed on other dielectric support structures or without dielectric support structures. When configured in this way, wireless signals conveyed by antenna 40A in structures 70-1 may interact with patch 174A as if patch 174A were an additional ground plane structure for the antenna, for example. Parasitic element 174A may serve to reduce electromagnetic coupling between antenna 40A in structures 70-1 and antenna 40A in structures 70-2, thereby enhancing the overall antenna efficiency of array 170.

Parasitic element 174B may be formed over parasitic element 174A. Parasitic element 174B may be an un-fed, non-radiative conductive patch such as a square conductive patch or a conductive patch having any other desired shape. Parasitic element 174B may be located at a first distance 176 from structures 70-1 and a second distance 178 from structures 70-2. Distance 176 may, for example, be approximately equal to half of the wavelength of operation of the antennas 40B in structures 70-1 and 70-2. As an example, distance 176 and/or distance 178 may be between 2 mm and 3 mm. In one suitable arrangement, distance 176 is approximately equal to distance 178. Because parasitic element 174A is located closer to structures 70-1 than structures 70-2, parasitic element 174B may thereby be located at a first distance 180 from the edge of parasitic 174A closest to structures 70-1 and a second shorter distance 182 from the opposing edge of parasitic 174A (e.g., parasitic 174B may be misaligned with respect to the center of parasitic 174A).

If desired, parasitic element 174B may be formed from conductive traces, stamped sheet metal, metal foil, metal electronic device housing structures, or other conductive structures on the same dielectric layer of substrate 120 as patches 104B (e.g., layer 122-4 of FIG. 7), on a different dielectric layer from patches 104B, or may be formed on other dielectric support structures or without dielectric support structures. Parasitic element 174B may serve to reduce electromagnetic coupling between antenna 40B in structures 70-1 and antenna 40B in structures 70-2, thereby enhancing the overall antenna efficiency of array 170.

The example of FIG. 10 is merely illustrative. If desired, parasitic elements 174A and/or 174B may be shorted to ground plane 92. In general, any desired parasitic elements having any desired placement, shape, and orientation may be interposed between structures 70-1 and 70-2. In the example of FIG. 10, the center of structures 70-1 (e.g., the center of the corresponding patches 104A and 104B and the center of the corresponding parasitic 106) is shown as being located at distance 172 from center the center of structures 70-2. Similarly, the center of structures 70-1 is shown as being located at distance 176 from the center of parasitic 174B. This is merely illustrative. In general, any desired point within the outline or on the edges of structures 70-1 (e.g., within the outline or on the edges of patch 104A) may be located at distance 172 from any desired point within the outline or on the edges of structures 70-2 and may be located at distance 176 from any desired point within the outline or on the edges of parasitic 174B. Array 170 may include any desired number of structures 70 (e.g., sixteen structures 70 and therefore thirty two antennas 40, fourteen structures 70 and therefore twenty-eight antennas 40, between ten and fourteen structures 70, between three and ten structures 70, more than sixteen structures 70, five structures 70 and therefore ten antennas 40, six structures 70 and therefore twelve antennas 40, etc.). In general, a greater number of structures 70 may increase the overall gain of array 170 (but also the overall manufacturing and operating complexity of array 60) relative to scenarios where fewer structures 70 are formed. Structures 70 may be arranged in any desired pattern.

Figure 11:
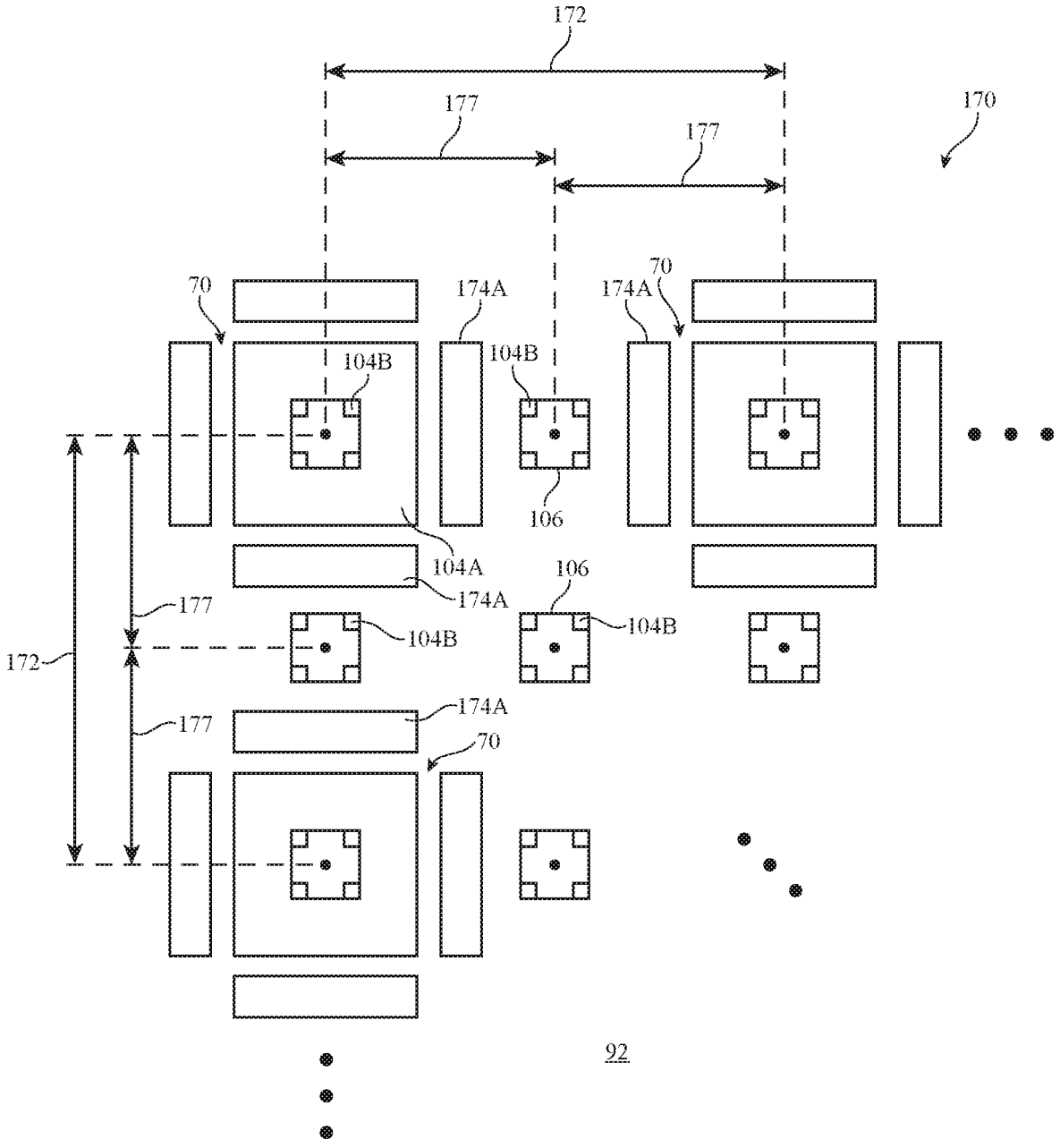

FIG. 11 is a top-down view showing another example of how antenna structures 70 of FIGS. 7-9 may be arranged within a phased antenna array 170. As shown in FIG. 11, multiple antenna structures 70 may be arranged in a grid or array (e.g., an array having aligned rows and columns). Each antenna structure 70 may be located at distance 172 with respect to the antenna structures 70 in adjacent rows and columns of the array. Two parasitic elements 174A may be interposed between each adjacent pair of antenna structures 70. Additional patch elements 104B and corresponding cross-shaped antenna resonating elements 106 may be interposed between each pair of antenna structures 70 (e.g., between two corresponding parasitic elements 174A). The patch element 104B and corresponding parasitic 106 within each antenna structure 70 may be located at a distance 177 from the patches 104B and parasitic elements 106 between structures 70. Distance 177 may be, for example, half of the wavelength of operation of antennas 40B. When arranged in this way, phased antenna array 170 may include patches 104B and the corresponding parasitic elements 106 arranged in an array having rows and columns, where patches 104B are located in every-other row and column. In this way, the patches 104B between structures 70 may utilize the same ground plane 92 as patches 104A. The example of FIG. 11 is merely illustrative. If desired, patches 104B and 104A may be arranged in any desired manner. The rows and columns of array 170 need not be aligned.

Figure 12:
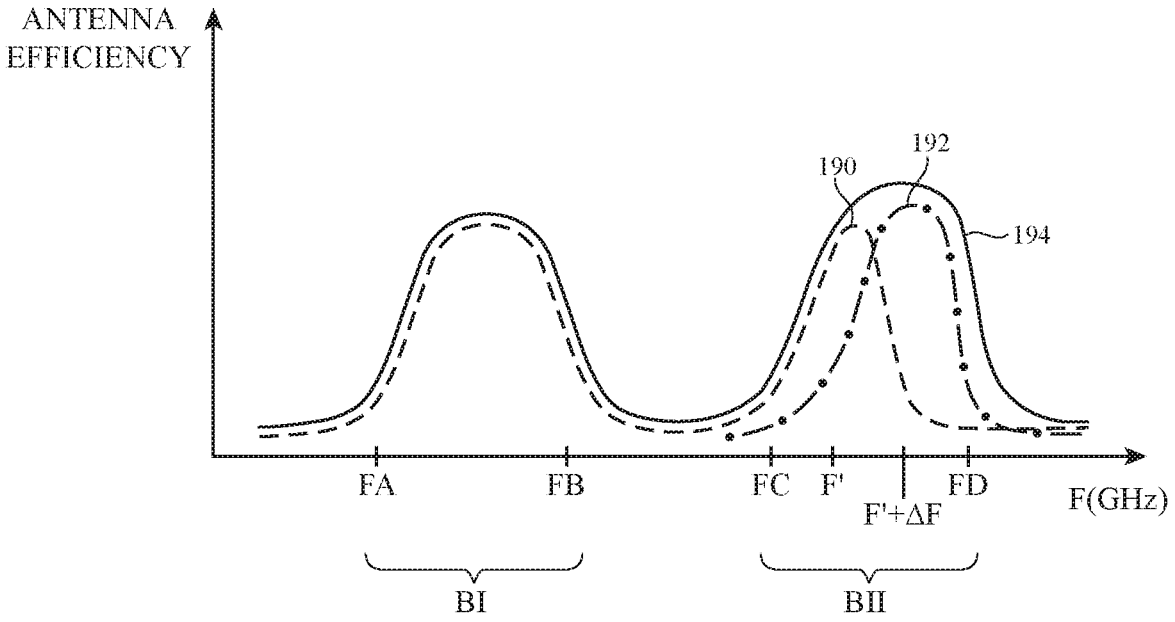
FIG. 12 is a graph of antenna efficiency for illustrative multi-band antenna structures of the type shown in FIGS. 5-11 in accordance with an embodiment.

FIG. 12 is a graph in which antenna performance (antenna efficiency) has been plotted as a function of operating frequency F for antenna structures 70. As shown in FIG. 12, efficiency curve 190 illustrates the antenna efficiency of structures 70 when operated in the absence of parasitic element 106. Curve 190 may have a first peak at within a first communications band BI between frequencies FA and FB and a second peak at frequency F'. Frequency F' may lie within a second communications BII between frequencies FC and FD. First communications band BI may sometimes be referred to herein as low band BI. Second communications band BII may sometimes be referred to herein as high band BII. The second peak of curve 190 at frequency F' may have a bandwidth that is too narrow to cover the entirety of communications band BII. Efficiency curve 192 illustrates the antenna efficiency of parasitic element 106. Curve 192 may have a peak at frequency F'+ΔF that is offset from frequency F' by offset value ΔF.

Efficiency curve 194 illustrates the antenna efficiency of structures 70 including the contributions of antenna 40A and antenna 40B having parasitic element 106. Efficiency curve 194 may exhibit a first peak in first communications band BI between frequencies FA and FB (e.g., due to the contribution of antenna 40A). Efficiency curve 194 may exhibit a second peak in second communications band BII between frequencies FC and FD due to the contribution of antenna 40B. As shown in FIG. 11, the antenna efficiency of antenna 40B in band BII may include contributions from both patch 104B and parasitic 106 such that antenna 40B exhibits an extended bandwidth that covers the entirety of band BII between frequencies FC and FD.

In one suitable example, frequency FA is 27.5 GHz, frequency FB is 28.5 GHz, frequency FC is 57 GHz, and frequency FD 71 GHz. This is merely illustrative and, in general, bands BI and BII may be any desired communications bands at frequencies between 10 GHz and 300 GHz. Frequencies FA through FD may be any desired frequencies between 10 GHz and 300 GHz (e.g., where frequency FA is less than frequency FB, frequency FB is less than frequency FC, and frequency FC is less than frequency FD). In this way, co-located antennas 40A and 40B (i.e., multi-band antenna structure 70) may cover multiple frequency bands greater than 10 GHz with satisfactory antenna efficiency in both bands and without occupying as much space within device 10 as when antennas 40A and 40B are formed at different locations within device 10, for example.

The example of FIG. 12 is merely illustrative. In general, curve 194 may have any desired shape (e.g., as determined by the arrangement of antennas 40A and 40B within structure 70). If desired, control circuitry 14 may perform simultaneous communications in bands BI and BII at any given time (e.g., because antenna 40A is suitably isolated from antenna 40B). If desired, antennas 40A or antenna 40B may be omitted from structure 70 (e.g., for only covering one of the first and second communications bands).

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a stacked dielectric substrate having a first layer, a second layer, a third layer, a fourth layer, and a fifth layer, the second layer being interposed between the first and third layers and the fourth layer being interposed between the fifth and first layers;

first metal traces on the first layer, wherein the first metal traces form a first antenna resonating element for a first antenna that handles antenna signals at a first frequency that is greater than 10 GHz;

second metal traces on the second layer, wherein the second metal traces form a second antenna resonating element for a second antenna that handles antenna signals at a second frequency that is higher than the first frequency;

third metal traces on the third layer that form a parasitic antenna resonating element for the second antenna;

fourth metal traces on the fourth layer that form an antenna ground, wherein at least one slot is formed in the fourth metal traces;

a first transmission line formed from fifth metal traces on the fifth layer that are coupled to the first metal traces through the fourth layer, the at least one slot, and the first layer; and a second transmission line formed from sixth metal traces on the fifth layer that are coupled to the second metal traces through the fourth layer, the at least one slot, the first layer, an opening in the first metal traces, and the second layer.

2. The electronic device defined in claim 1, wherein the first layer is interposed between the fourth and second layers, and the antenna ground serves as an antenna ground for the first and second antennas.

3. The electronic device defined in claim 2, wherein the first antenna comprises a first antenna feed having a first feed terminal on the first metal traces and the second antenna comprises a second antenna feed having a second feed terminal on the second metal traces, the first transmission line is coupled to the first feed terminal on the first metal traces, and the second transmission line is coupled to the second feed terminal on the second metal traces through the opening in the first metal traces.

4. The electronic device defined in claim 3, wherein the first antenna further comprises a third antenna feed having a third feed terminal on the first metal traces, the electronic device further comprising:

a third transmission line coupled to the third feed terminal on the first metal traces.

5. The electronic device defined in claim 4, wherein the second antenna further comprises a fourth antenna feed having a fourth feed terminal on the second metal traces and an additional opening is formed in the first metal traces, the electronic device further comprising:

a fourth transmission line coupled to the fourth feed terminal on the second metal traces through the additional opening.

6. The electronic device defined in claim 4, wherein the opening has first and second arms extending along a first longitudinal axis and third and fourth arms extending along a second longitudinal axis that is oriented at a non-parallel angle with respect to the first longitudinal axis, and the first arm of the opening is interposed between the first and third feed terminals on the first metal traces.

7. The electronic device defined in claim 6, wherein the second antenna further comprises a fourth antenna feed having a fourth feed terminal on the second metal traces, the electronic device further comprising:

a fourth transmission line coupled to the fourth feed terminal on the second metal traces through a selected one of the first and second arms of the opening in the first metal traces, wherein the second transmission line is coupled to the second feed terminal on the second metal traces through a selected one of the third and fourth arms of the opening in the first metal traces.

8. The electronic device defined in claim 1, wherein the parasitic antenna resonating element comprises first and second arms that extend along a first longitudinal axis and third and fourth arms that extend along a second longitudinal axis that is oriented at a non-parallel angle with respect to the first longitudinal axis.

9. The electronic device defined in claim 8, wherein the first metal traces comprise a metal patch having first, second, third, and fourth edges, the first edge is parallel to the second edge, the third edge is parallel to the fourth edge, the third and fourth edges extend between the first and second edges at non-parallel angles with respect to the first edge, the first longitudinal axis of the parasitic antenna resonating element is extends approximately parallel to the first and second edges of the metal patch, and the second longitudinal axis of the parasitic antenna resonating element extends approximately parallel to the third and fourth edges of the metal patch.

10. The electronic device defined in claim 8, wherein the second antenna comprises a third antenna feed having a third feed terminal on the second metal traces, the first arm of the parasitic antenna resonating element overlaps the second feed terminal on the second metal traces, and the third arm of the parasitic antenna resonating element overlaps the third feed terminal on the second metal traces.

11. The electronic device defined in claim 1, wherein the at least one slot comprises first and second slots, the fifth metal traces are coupled to the first metal traces through the first slot, and the sixth metal traces are coupled to the second metal traces through the second slot.

12. Antenna structures, comprising:

an antenna ground;

a first patch antenna resonating element over the antenna ground;

first and second antenna feed terminals coupled to the first patch antenna resonating element;

a second patch antenna resonating element over the first patch antenna resonating element;

a cross-shaped opening in the first patch antenna resonating element, the cross-shaped opening having first and second arms, one of which is interposed between the first and second antenna feed terminals;

a first transmission line coupled to the first patch antenna resonating element;

a second transmission line coupled to the second patch antenna resonating element through the cross-shaped opening in the first patch antenna resonating element; and a cross-shaped parasitic antenna resonating element over the second patch antenna resonating element, wherein first and second arms of the cross-shaped parasitic antenna resonating element overlap the first and second arms of the cross-shaped opening in the first patch antenna resonating element respectively.

13. The antenna structures defined in claim 12, further comprising:

a third transmission line, wherein the first transmission line is coupled to the first antenna feed terminal, the third transmission line is coupled to the second antenna feed terminal.

14. The antenna structures defined in claim 13, further comprising:

third and fourth antenna feed terminals coupled to the second patch antenna resonating element; and a fourth transmission line, wherein the second transmission line is coupled to the third antenna feed terminal through the cross-shaped opening and the fourth transmission line is coupled to the fourth antenna feed terminal through the cross-shaped opening.

15. The antenna structures defined in claim 12, further comprising:

a third antenna feed terminal coupled to the antenna ground;

a cross-shaped parasitic antenna resonating element over the second patch antenna resonating element;

a third patch antenna resonating element over the antenna ground; and a non-radiative parasitic element formed over the antenna ground and between the first patch antenna resonating element and the third patch antenna resonating element.

16. Antenna structures, comprising:

an antenna ground;

a first conductive patch over the antenna ground;

an antenna feed having a first antenna feed terminal coupled to the first conductive patch and a second antenna feed terminal coupled to the antenna ground;

a second conductive patch over the first conductive patch;

a third conductive patch over the antenna ground;

a fourth conductive patch over the third conductive patch;

a first parasitic element formed over the antenna ground and between the first conductive patch and the third conductive patch, the first parasitic element being configured to reduce electromagnetic coupling between the first and third conductive patches; and a second parasitic element formed over the first parasitic element and between the second conductive patch and the fourth conductive patch, the second parasitic element being configured to reduce electromagnetic coupling between the second and fourth conductive patches.

17. The antenna structures defined in claim 16, further comprising:

a third antenna feed terminal coupled to the first conductive patch;

an opening in the first conductive patch, the opening having a portion that is between the first and third antenna feed terminals;

a first transmission line coupled to the first conductive patch; and a second transmission line coupled to the second conductive patch through the opening in the first conductive patch.

18. The antenna structures defined in claim 17 wherein the opening in the first conductive patch is a cross-shaped opening and the portion of the opening is an arm of the cross-shaped opening.

19. The antenna structures defined in claim 16, wherein the first conductive patch is formed on a first substrate layer, the first parasitic element is formed on the first substrate layer, the second conductive patch is formed on a second substrate layer, and the second parasitic element is formed on the second substrate layer.

20. The antenna structures defined in claim 16, wherein the first parasitic element has first and second opposing edges, the first edge being an edge of the first parasitic element closest to the first conductive patch and being separated from the first conductive patch by a first distance, and the second edge being an edge of the first parasitic element closest to the third conductive patch and being separated from the third conductive patch by a second distance greater than the first distance.

* * * * *